US009010923B2

(12) United States Patent
Inoue et al.

(10) Patent No.: US 9,010,923 B2
(45) Date of Patent: Apr. 21, 2015

(54) SHEET CONVEYING DEVICE AND INK JET RECORDING APPARATUS

(75) Inventors: Takahiro Inoue, Kanagawa (JP); Takehiko Nakayama, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 213 days.

(21) Appl. No.: 13/409,470

(22) Filed: Mar. 1, 2012

(65) Prior Publication Data

US 2012/0224012 A1 Sep. 6, 2012

(30) Foreign Application Priority Data

Mar. 3, 2011 (JP) ..... 2011-046539

(51) Int. Cl.

| | |
|---|---|
| ***B41J 2/01*** | (2006.01) |
| ***B41F 21/00*** | (2006.01) |
| ***B41J 13/22*** | (2006.01) |
| *B41J 13/02* | (2006.01) |
| *B41J 13/03* | (2006.01) |
| *B41J 11/00* | (2006.01) |

(52) U.S. Cl.

CPC ..... *B41F 21/00* (2013.01); *B41J 13/226* (2013.01); *B41J 13/02* (2013.01); *B41J 13/025* (2013.01); *B41J 13/03* (2013.01); *B41J 11/0085* (2013.01); *B41J 13/223* (2013.01)

(58) Field of Classification Search

CPC ..... B41J 11/007; B41J 11/06; B41J 2/2114; B41J 11/0015

USPC ..... 347/104, 101

See application file for complete search history.

(56) References Cited

U.S. PATENT DOCUMENTS

| | | | | | |
|---|---|---|---|---|---|
| 3,291,482 | A | * | 12/1966 | Stemmler | 271/11 |
| 4,019,731 | A | * | 4/1977 | Vits | 271/183 |
| 4,087,177 | A | * | 5/1978 | Gumm et al. | 355/47 |
| 4,386,771 | A | * | 6/1983 | Lakdawala | 271/82 |
| 4,450,080 | A | * | 5/1984 | Dodd | 210/391 |
| 4,490,132 | A | * | 12/1984 | Ogura et al. | 493/424 |
| 4,493,255 | A | | 1/1985 | Fischer | |
| 4,495,746 | A | * | 1/1985 | Focke et al. | 53/389.3 |
| 4,526,360 | A | * | 7/1985 | Focke | 271/122 |
| 4,635,921 | A | * | 1/1987 | Thomas | 271/94 |
| 4,703,923 | A | * | 11/1987 | Anderson et al. | 271/3.11 |
| 4,887,805 | A | * | 12/1989 | Herbert et al. | 271/94 |
| 5,007,626 | A | * | 4/1991 | Blaimschein | 271/33 |

(Continued)

FOREIGN PATENT DOCUMENTS

| | | | |
|---|---|---|---|
| EP | 0085751 | A1 | 8/1983 |
| JP | 2009-220954 | A | 10/2009 |

*Primary Examiner* — Julian Huffman

*Assistant Examiner* — Leonard S Liang

(74) *Attorney, Agent, or Firm* — Birch, Stewart, Kolasch & Birch, LLP

(57) ABSTRACT

Disclosed are a sheet conveying device and an ink jet recording apparatus capable of conveying a sheet in close contact with a drum without wrinkles. In a sheet conveying mechanism which presses a pressing roller against the front surface of a sheet being conveyed by a conveying drum to bring the sheet into close contact with the outer circumferential surface of the conveying drum, a back tension application device is provided at a position immediately before the sheet enters between the conveying drum and the pressing roller. The back tension application device sucks the front surface of the sheet to apply back tension to the sheet. Therefore, it is possible to prevent slackness of the sheet which enters between the pressing roller and the conveying drum and to prevent the occurrence of wrinkles.

23 Claims, 17 Drawing Sheets

(56) References Cited

U.S. PATENT DOCUMENTS

| | | | | |
|---|---|---|---|---|
| 5,243,909 | A * | 9/1993 | DeMoore et al. | 101/420 |
| 5,697,606 | A * | 12/1997 | Maass | 271/197 |
| 5,871,433 | A * | 2/1999 | Lehmann et al. | 493/420 |
| 5,899,449 | A * | 5/1999 | Acquaviva et al. | 271/12 |
| 6,269,743 | B1 * | 8/2001 | DeMoore et al. | 101/420 |
| 6,378,425 | B1 * | 4/2002 | Stephan | 101/232 |
| 6,601,501 | B2 * | 8/2003 | Takai | 101/118 |
| 6,746,010 | B2 * | 6/2004 | Ozaki | 271/3.21 |
| 7,243,916 | B2 * | 7/2007 | Jensen | 271/97 |
| 8,262,080 | B2 * | 9/2012 | Matsumoto et al. | 271/98 |
| 2001/0017441 | A1 * | 8/2001 | Yamaguchi et al. | 271/94 |
| 2004/0089994 | A1 * | 5/2004 | Koga et al. | 271/98 |
| 2007/0013122 | A1 * | 1/2007 | Kawai | 271/90 |
| 2009/0231377 | A1 * | 9/2009 | Kachi | 347/16 |
| 2011/0187042 | A1 * | 8/2011 | Fuda | 271/12 |
| 2011/0224073 | A1 * | 9/2011 | Owashi et al. | 503/200 |
| 2011/0316953 | A1 * | 12/2011 | Kaneko et al. | 347/104 |

* cited by examiner

SHEET CONVEYING DEVICE AND INK JET RECORDING APPARATUS

BACKGROUND OF THE INVENTION

1. Field of the Invention

The present invention relates to a sheet conveying device and an ink jet recording apparatus. In particular, the present invention relates to a sheet conveying device which conveys a sheet by a drum and an ink jet recording apparatus.

2. Description of the Related Art

As a method of conveying a sheet in an ink jet recording apparatus, a drum conveying method is known. In the drum conveying method, a sheet is wound around on the outer circumferential surface of a drum, and the drum rotates to convey the sheet.

JP 2009-220954A describes an ink jet recording apparatus which uses the drum conveying method. In this ink jet recording apparatus, in order to prevent the occurrence of floating or wrinkles in a sheet wound around the drum, a suction mechanism is provided in a conveying guide which guides the sheet to the drum, and the sheet is transferred to the drum while back tension is applied to the sheet.

SUMMARY OF THE INVENTION

On the other hand, at a place, such as a printing unit, where smoothness of a sheet is required, in order to bring the sheet into close contact with the drum, a pressing roller is provided above the outer circumferential surface of the drum. The pressing roller presses the front surface (the same surface of a printing surface) of the sheet wrapped around the outer circumferential surface of the drum to bring the sheet into close contact with the drum. When the pressing roller is provided, the sheet is brought into close contact with the drum from the leading end portion thereof. At this time, if the sheet is not supported, the sheet is slack, and wrinkles occur during pressing.

In JP 2009-220954A, while the sheet is being guided by the conveying guide, the sheet is not bent and can be guided between the drum and the pressing roller by the effect of back tension. However, if the sheet has passed through the conveying guide, back tension is not applied to the sheet, and the sheet is slack in the trailing end portion of the sheet, causing the occurrence of wrinkles during pressing.

In JP 2009-220954A, the rear surface (the surface opposite to the printing surface) of the sheet is brought into close contact with the conveying guide by suction, and back tension is applied to the sheet. In this case, if an image has been recorded on the rear surface (during duplex printing or the like), the image may be damaged.

The present invention has been made in view of the above-mentioned problems and an object of the present invention is to provide a sheet conveying device and an ink jet recording apparatus capable of conveying a sheet in close contact with a drum without wrinkles.

Means for solving the problem is as follows.

[1] A first aspect of the present invention provides a sheet conveying device which conveys sheets. The sheet conveying device includes a drum which rotates with a sheet wound around the outer circumferential surface thereof to convey the sheet, a pressing roller which is provided on the outer circumferential surface of the drum, presses the front surface of the sheet to bring the rear surface of the sheet into close contact with the outer circumferential surface of the drum, and a back tension application unit which sucks the front surface of the sheet at a position immediately before the sheet enters between the drum and the pressing roller to apply back tension to the sheet. Here, the suction of the front surface of the sheet at the position immediately before the sheet enters between the drum and the pressing roller means that the back tension application unit sucks the sheet in a state where the pressing roller and the back tension application unit do not interfere with each other, and the back tension application unit is at a position near the pressing roller.

With this aspect, the front surface of the sheet is sucked at the position immediately before the sheet enters between the drum and the pressing roller, and back tension is applied to the sheet. Accordingly, it is possible to allow the sheet to enter between the drum and the pressing roller constantly without causing slackness. Therefore, it is possible to bring the sheet into close contact with the outer circumferential surface of the drum without causing wrinkles. Since the front surface of the sheet is sucked and back tension is applied to the sheet, even if an image has been recorded on the rear surface, the image is not damaged.

[2] According to a second aspect of the present invention, in the sheet conveying device of the first aspect, the drum may have an adsorbing and holding unit which adsorbs and holds the rear surface of the sheet wound around the outer circumferential surface.

With this aspect, the rear surface of the sheet is adsorbed to the outer circumferential surface of the drum, and the sheet is conveyed to the drum. Therefore, it is possible to more reliably bring the sheet into close contact with the outer circumferential surface of the drum.

[3] According to a third aspect of the present invention, in the sheet conveying device of the first or second aspect, the drum may have a leading end gripping unit which grips the leading end of the sheet.

With this aspect, the leading end of the sheet is gripped, and the sheet is conveyed to the drum. Therefore, it is possible to convey the sheet without causing slipping of the sheet.

[4] According to a fourth aspect of the present invention, in the sheet conveying device of any one of the first to third aspects, the back tension application unit may include a sheet guide which has a guide surface in slide contact with the front surface of the sheet, a suction hole being formed in the guide surface, and a suction unit which sucks the sheet from the suction hole to bring the front surface of the sheet into close contact with the guide surface.

With this aspect, the front surface of the sheet is sucked, such that the sheet is conveyed in close contact with the guide surface, and back tension is applied to the sheet. Therefore, it is possible to stabilize the traveling of the sheet and to reliably apply back tension to the sheet.

[5] According to a fifth aspect of the present invention, in the sheet conveying device of the fourth aspect, the cross-section shape of the guide surface in a direction perpendicular to the conveying direction of the sheet may have an arc shape.

With this aspect, the cross-section shape of the guide surface in the width direction (the direction perpendicular to the conveying direction of the sheet) has an arc shape. When sliding on the guide surface, the sheet travels along with the guide surface while being warped. Accordingly, it is possible to effectively prevent slackness of both end portions of the sheet in the width direction (the direction perpendicular to the conveying direction). During pressing by the pressing roller, it is possible to press the pressing roller against the sheet from the center of the sheet toward both ends in the width direction. Accordingly, it is possible to effectively prevent the occurrence of wrinkles. The arc may be formed to be convex toward the outer circumferential surface of the drum or may be formed to be concave toward the outer circumferential surface of the drum.

[6] According to a sixth aspect of the present invention, in the sheet conveying device of the fourth or fifth aspect, the cross-section shape of the guide surface in a direction parallel to the conveying direction of the sheet may have an arc shape.

With this aspect, the cross-section shape of the guide surface in the sheet conveying direction has an arc shape. Accordingly, it is possible to expand the contact area of the sheet during sliding. Therefore, it is possible to stably convey the sheet and to increase a holding force of the sheet.

[7] According to a seventh aspect of the present invention, in the sheet conveying device of the fourth aspect, the guide surface may be flat.

With this aspect, the guide surface is flat. Therefore, it is possible to allow the sheet to enter between the drum and the pressing roller in an upright state.

[8] According to an eighth aspect of the present invention, in the sheet conveying device of any one of the fourth to seventh aspects, the slit-like suction hole in the guide surface may be perpendicular to the conveying direction of the sheet.

With this aspect, the suction hole formed in the guide surface is slit-like and is formed to be perpendicular to the conveying direction of the sheet. Therefore, it is possible to adsorb the sheet in the width direction of the sheet in a continuous manner and to obtain a large holding force. A plurality of suction holes may be arranged in parallel.

[9] According to a ninth aspect of the present invention, in the sheet conveying device of any one of the fourth to seventh aspects, the slit-like suction hole in the guide surface may be inclined with respect to the conveying direction of the sheet.

With this aspect, the suction hole formed in the guide surface is slit-like and inclined with respect to the conveying direction of the sheet (for example, is formed along the diagonal of the guide surface). Accordingly, it is possible to adsorb the sheet in the width direction of the sheet in a continuous manner and to obtain a large holding force. When the sheet is sliding on the guide surface, it is possible to smooth wrinkles from one side of the sheet in the width direction toward the other side. A plurality of suction holes may be arranged in parallel.

[10] According to a tenth aspect of the present invention, in the sheet conveying device of any one of the fourth and seventh aspects, a plurality of suction holes may be formed in the guide surface at a predetermined spacing in a direction perpendicular to the conveying direction of the sheet.

With this aspect, a plurality of suction holes are formed in the guide surface at a predetermined spacing along the width direction. Accordingly, it is possible to suppress deformation of the sheet, thereby smoothly guiding the sheet. The shape of each suction hole is not particularly limited. For example, the shape of each suction hole may be a circular shape or an elongated hole shape (including an elliptical shape and a rectangular shape).

[11] According to an eleventh aspect of the present invention, in the sheet conveying device of the tenth aspect, each suction hole may be formed in an elongated hole shape to be in parallel to the conveying direction of the sheet.

With this aspect, each suction hole arranged at a regular spacing along the width direction of the guide surface has an elongated hole shape (a hole shape (including an elliptical shape, a rectangular shape, and the like) in which the vertical width and the horizontal width are different) extending in a direction parallel to the conveying direction of the sheet. Therefore, it is possible to suppress deformation of the sheet and to increase a holding force.

[12] According to a twelfth aspect of the present invention, in the sheet conveying device of the tenth aspect, each suction hole may be formed in an elongated hole shape to be inclined with respect to the conveying direction of the sheet.

With this aspect, each suction hole arranged at a regular pitch along the width direction of the guide surface has an elongated hole shape and is formed to be inclined with respect to the conveying direction of the sheet. Therefore, when the sheet is sliding on the guide surface, it is possible to smooth wrinkles from one side of the sheet in the width direction toward the other side.

[13] According to a thirteenth aspect of the present invention, in the sheet conveying device of the twelfth aspect, each suction hole may be inclined such that an end portion on the upstream side in the conveying direction of the sheet is at the center of the guide surface from an end portion on the downstream side.

With this aspect, each suction hole arranged at a regular spacing along the width direction of the guide surface has an elongated hole shape, and is formed to be inclined with respect to the conveying direction of the sheet such that the end portion on the upstream side in the conveying direction of the sheet is at the center of the guide surface from the end portion on the downstream side. Therefore, when the sheet is sliding on the guide surface, it is possible to smooth wrinkles from the center of the sheet toward both ends in the width direction. In this case, the suction holes are formed to be symmetrical to the center of the guide surface in the width direction.

[14] According to a fourteenth aspect of the present invention, in the sheet conveying device of the thirteenth aspect, a suction hole which is further away from the center of the guide surface may have a larger inclination angle.

With this aspect, when each suction hole is formed to be inclined such that the end portion on the upstream side in the conveying direction of the sheet is at the center of the guide surface from the end portion on the downstream side, a suction hole which is further away from the center of the guide surface has a larger inclination angle. Therefore, it is possible to gradually smooth wrinkles from the center of the sheet toward both ends in the width direction and to further increase the effect of smoothing wrinkles.

[15] According to a fifteenth aspect of the present invention, in the sheet conveying device of any one of the eleventh to fourteenth aspects, each suction hole may be formed by assembling a plurality of circular holes and may have an elongated hole shape as a whole.

With this aspect, when the suction hole is formed in an elongated hole shape, a plurality of circular holes having a small diameter are assembled to have an elongated hole shape as a whole (the appearance has an elongated hole shape). Therefore, it is possible to obtain a large holding force and to suppress deformation of the sheet. It is also possible to easily perform manufacturing.

[16] According to a sixteenth aspect of the present invention, in the sheet conveying device of the fourth or fifth aspect, the cross-section shape of the guide surface in a direction parallel to the conveying direction of the sheet may have a wave shape, and the suction hole may be formed in a trough portion.

With this aspect, the cross-section shape of the guide surface in parallel to the conveying direction of the sheet has a wave shape, and the suction hole is formed in the trough portion. Therefore, it is possible to increase a holding force of the sheet. The shape of the suction hole is not particularly limited. For example, a slit-like hole may be formed along the trough portion. Alternatively, an elongated hole shape or a circular hole shape may be used at a regular pitch along the trough portion.

[17] According to a seventh aspect of the present invention, in the sheet conveying device of any one of the fourth to sixteenth aspects, the sheet guide may have a hollow portion, the suction hole may communicate with the hollow portion, a vacuum prevention hole may communicate with the hollow portion, and the hollow portion may be sucked by the suction unit.

With this aspect, since the hollow portion is formed in the sheet guide, the hollow portion is sucked, such that the sheet is sucked from the suction hole formed in the guide surface. The vacuum prevention hole communicates with the hollow portion, thereby preventing the sheet from being sucked by an excess suction force. Therefore, it is possible to suck the sheet with an appropriate suction force and to apply back tension to the sheet.

[18] According to an eighteenth aspect of the present invention, in the sheet conveying device of any one of the fourth to seventeenth aspects, the sheet guide may be configured such that the direction of the guide surface is adjustable.

With this aspect, it is possible to adjust the direction of the guide surface. Therefore, it is possible to appropriately guide the sheet depending on the type, thickness, or the like of the sheet, and to apply back tension to the sheet.

[19] According to a nineteenth aspect of the present invention, in the sheet conveying device of any one of the fourth to seventeenth aspects, the back tension application unit may suck the front surface of the sheet such that the sheet is wrapped around the pressing roller.

With this aspect, the back tension application unit is provided such that the front surface of the sheet is sucked and the sheet is wrapped around the pressing roller. Therefore, it is possible to effectively smooth wrinkles. This adjustment is done by adjusting, for example, the suction direction, the direction of the guide surface, or the like.

[20] According to a twentieth aspect of the present invention, in the sheet conveying device of any one of the fourth to seventeenth aspects, the back tension application unit may suck the front surface of the sheet such that the sheet which enters between the drum and the pressing roller travels along the tangent line line to the outer circumference of the drum at a contact of the drum and the pressing roller.

With this aspect, the back tension application unit is provided such that the sheet travels along the tangent line line to the outer circumference of the drum at the contact of the drum and the pressing roller. Therefore, it is possible to allow the sheet to smoothly enter between the drum and the pressing roller and to effectively prevent the occurrence of wrinkles during pressing by the pressing roller. This adjustment is done by adjusting, for example, the suction direction, the direction of the guide surface, or the like.

[21] According to a twenty-first aspect of the present invention, the sheet conveying device of any one of the first to twentieth aspects may further include a rotating and conveying unit which rotates while gripping the leading end of the sheet to convey the sheet. The sheet may be fed from the rotating and conveying unit to the drum.

With this aspect, the sheet is transferred from the rotating and conveying unit to the drum. In a configuration in which the sheet is received from the rotating and conveying unit, it is difficult to provide the pressing roller near the position where the sheet is received from the rotating and conveying unit. For this reason, although the sheet is pressed by the pressing roller at a position away from the position where the drum has received the sheet, the front surface of the sheet is sucked immediately before the sheet is pressed by the pressing roller, and back tension is applied to the sheet. Therefore, it is possible to bring the sheet into close contact with the outer circumferential surface of the drum without causing wrinkles.

[22] A further aspect of an ink jet recording apparatus includes the sheet conveying device of any one of the first to twenty-first aspects, and an ink jet head which ejects ink droplets onto the front surface of the sheet being conveyed by the drum.

With this aspect, since the sheet is held on the outer circumferential surface of the drum without wrinkles, it is possible to record a high-quality image. Even if an image has been recorded on the rear surface, it is possible to convey the sheet without causing damage to the recorded image.

According to the aspects of the present invention, it is possible to convey the sheet in close contact with the drum without wrinkles. Therefore, it is possible to record a high-quality image.

DESCRIPTION OF THE PREFERRED EMBODIMENTS

Hereinafter, preferred embodiments of the present invention will be described in detail with reference to the drawings.

<<Overall Configuration of Ink Jet Recording Apparatus>>

Figure 1:
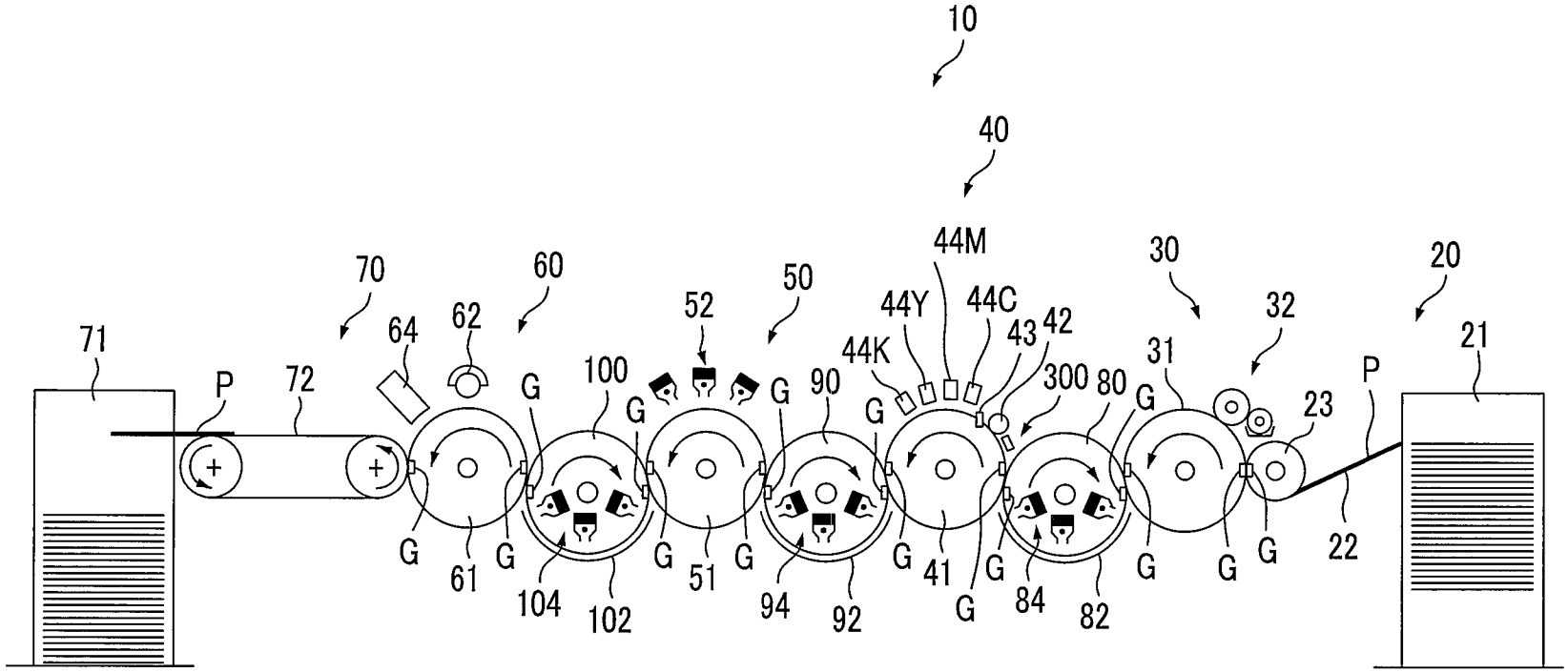
FIG. 1 is an overall configuration diagram showing an embodiment of an ink jet recording apparatus according to the present invention.

FIG. 1 is an overall configuration diagram showing an embodiment of an ink jet recording apparatus according to the present invention.

An ink jet recording apparatus 10 is an apparatus which performs printing on sheets P using aqueous ink (ink containing water in a solvent) by an ink jet method. The ink jet recording apparatus 10 includes a sheet feeding unit 20 which feeds a sheet P, a processing liquid coating unit 30 which coats a predetermined processing liquid on the front surface (printing surface) of the sheet P, an image recording unit 40 which dots ink droplets of the respective colors of cyan (C), magenta (M), yellow (Y), and black (K) onto the printing surface of the sheet P by an ink jet head to draw a color image, an ink drying unit 50 which dries the ink droplets dotted onto the sheet P, a fixing unit 60 which fixes an image recorded on the sheet P, and a collection unit 70 which collects the sheet P.

The processing liquid coating unit 30, the image recording unit 40, the ink drying unit 50, and the fixing unit 60 respectively include conveying drums 31, 41, 51, and 61 as a conveying unit of the sheet P. The sheet P is conveyed to the processing liquid coating unit 30, the image recording unit 40, the ink drying unit 50, and the fixing unit 60 by the conveying drums 31, 41, 51, and 61.

Each of the conveying drums 31, 41, 51, and 61 is formed in a cylindrical shape to correspond to the sheet width. Each of the conveying drums 31, 41, 51, and 61 is driven by a motor (not shown) to rotate (in FIG. 1, rotate in the counterclockwise direction). The sheet P is wound around the outer circumferential surface of each of the conveying drums 31, 41, 51, and 61 and conveyed.

On the circumferential surface of each of the conveying drums 31, 41, 51, and 61, grippers which are one of leading end gripping units are provided. The sheet P is conveyed with the leading end portion thereof gripped by the grippers. In this example, grippers G are provided at two points on the circumferential surface of each of the conveying drums 31, 41, 51, and 61. The grippers G are provided at an spacing of 180°. Accordingly, two sheets can be conveyed by single rotation.

Each of the conveying drums 31, 41, 51, and 61 includes an adsorbing and holding mechanism (adsorbing and holding unit) which adsorbs and holds the sheet P wound around the outer circumferential surface. In this example, the sheet P is adsorbed and held on the outer circumferential surface using air pressure (negative pressure). To this end, in the outer circumferential surface of each of the conveying drums 31, 41, 51, and 61, a plurality of suction holes are formed. The sheet P is adsorbed and held on the outer circumferential surface of each of the conveying drums 31, 41, 51, and 61 while the rear surface thereof is sucked from the suction holes. The adsorbing and holding mechanism may use a method (a so-called electrostatic adsorption method) which uses static electricity.

Transfer drums (rotating and conveying unit) 80, 90, and 100 are respectively arranged between the processing liquid coating unit 30 and the image recording unit 40, between the image recording unit 40 and the ink drying unit 50, and between the ink drying unit 50 and the fixing unit 60. The sheet P is conveyed between the units by the transfer drums 80, 90, and 100.

Each of the transfer drums 80, 90, and 100 is formed of a cylindrical frame to correspond to the sheet width. Each of the transfer drums 80, 90, and 100 is driven by a motor (not shown) to rotate (in FIG. 1, rotate in the clockwise direction).

On the circumferential surface of each of the transfer drums 80, 90, and 100, grippers G are provided. The sheet P is conveyed with the leading end portion thereof gripped by the grippers G In this example, grippers G are provided at two points on the outer circumference of each of the transfer drums 80, 90, and 100. The grippers G are provided at an spacing of 180°. Accordingly, two sheets can be conveyed by single rotation.

Below the transfer drums 80, 90, and 100, arc-shaped guide plates 82, 92, and 102 are respectively arranged along the conveying path of the sheet P. The sheet P is conveyed by the transfer drums 80, 90, and 100 while the rear surface (the surface opposite to the printing surface) thereof is guided by the guide plates 82, 92, and 102.

Inside the transfer drums 80, 90, and 100, dryers 84, 94, and 104 are respectively provided to blow out heated air toward the sheet P being conveyed by the transfer drum (in this example, three dryers are provided along the conveying path of the sheet P). While the sheet P is being conveyed by the transfer drums 80, 90, and 100, heated air blows from the dryers 84, 94, and 104 on the rear surface of sheet P respectively. Accordingly, it is possible to dry the sheet P during conveying by the transfer drums 80, 90, and 100.

The dryers 84, 94, and 104 may have a configuration in which heat is emitted from an infrared heater or the like to heat the sheet P (heating by so-called radiation), instead of a configuration in which heated air blows out to heat the sheet P.

The sheet P fed from the sheet feeding unit 20 is conveyed in an order of the conveying drum 31→the transfer drum 80→the conveying drum 41→the transfer drum 90→the conveying drum 51→the transfer drum 100→the conveying drum 61, and is finally collected by the collection unit 70. The sheet P is subjected to a necessary process until the sheet P is collected by the collection unit 70 after having been fed from the sheet feeding unit 20, and an image is recorded on the printing surface.

Hereinafter, the configuration of each unit of the ink jet recording apparatus 10 of this embodiment will be described in detail.

<Sheet Feeding Unit>

The sheet feeding unit 20 periodically feeds the sheets P one by one. The sheet feeding unit 20 primarily includes a sheet feeding device 21, a sheet feed tray 22, and a transfer drum 23.

The sheet feeding device 21 sequentially feeds the sheet P stacked in a magazine (not shown) to the sheet feed tray 22 one by one from the uppermost one.

The sheet feed tray 22 sends the sheet P fed from the sheet feeding device 21 toward the transfer drum 23.

The transfer drum 23 receives the sheet P sent from the sheet feed tray 22 and rotates to transfer the sheet P to the conveying drum 31 of the processing liquid coating unit 30.

As the sheets P which are used by the ink jet recording apparatus 10 of this embodiment, general printing sheets (not ink jet-exclusive sheets and sheets which used in general offset printing (cellulose-based sheets, such as high-quality sheets, coated sheets, and art sheets) are used.

In regard to the general printing sheets, if printing is performed by the ink jet method, blotting or the like occurs, and the quality of an image is damaged. Accordingly, in order to prevent this problem, a predetermined processing liquid is coated on the sheet P by the subsequent processing liquid coating unit 30.

<Processing Liquid Coating Unit>

The processing liquid coating unit 30 coats a predetermined processing liquid on the printing surface of the sheet P. The processing liquid coating unit 30 primarily includes the conveying drum (hereinafter, referred to as "processing liquid coating drum") 31 which conveys the sheet P, and a coating device 32 which coats a predetermined processing liquid on the printing surface of the sheet P being conveyed by the processing liquid coating drum 31.

The processing liquid coating drum 31 receives the sheet P from the transfer drum 23 of the sheet feeding unit 20 (receives the sheet P with the leading end of the sheet P gripped by the grippers G), and rotates to convey the sheet P along a predetermined conveying path.

The coating device 32 roller-coats a predetermined processing liquid on the printing surface of the sheet P being conveyed by the processing liquid coating drum 31. That is, a coating roller with the processing liquid applied to the circumferential surface thereof is pressed against and brought into contact with the printing surface of the sheet P being conveyed by the processing liquid coating drum 31, and the processing liquid is coated on the printing surface of the sheet P. The processing liquid is coated at a given thickness.

The processing liquid coated by the coating device 32 includes a liquid containing an aggregating agent, which aggregates components in an ink composition.

As the aggregating agent, compounds which can change the pH of the ink composition, multivalent metal salts, and polyallylamines may be used.

Preferred examples of the compound which lowers the pH include acid materials having high water solubility (phosphoric acid, oxalic acid, malonic acid, citric acid, derivatives of compounds of these acids, salts of these acids, and the like). The acid material may be used alone or two or more acid materials may be used in combination. Accordingly, it is possible to increase aggregability and to immobilize the entire ink.

It is preferable that the pH (25° C.) of the ink composition is equal to or greater than 8.0, and the pH (25° C.) of the processing liquid is in a range of 0.5 to 4. Accordingly, it is possible to achieve image density, resolution, and high-speed ink jet recording.

The processing liquid may contain additives. For example, the processing liquid may contain known additives, an anti-drying agent (wetting agent), an anti-fading agent, an emulsion stabilizer, a penetration enhancer, an ultraviolet absorber, a preservative, an antifungal agent, a pH regulator, a surface tension regulator, an antifoamer, a viscosity modifier, a dispersant, a dispersion stabilizer, a corrosion inhibitor, and a chelating agent.

The processing liquid is coated on the printing surface of the sheet P in advance and printing is performed, making it possible to prevent the occurrence of feathering, bleeding, or the like and, even if a general printing sheet is used, to perform high-quality printing.

In the processing liquid coating unit 30 configured as above, the sheet P is held by the processing liquid coating drum 31 and conveyed along a predetermined conveying path. During conveying, the processing liquid is coated on the printing surface by the coating device 32.

The sheet P with the processing liquid coated on the printing surface is thereafter transferred from the processing liquid coating drum 31 to the transfer drum 80 at a predetermined position. The sheet P is conveyed along a predetermined conveying path by the transfer drum 80 and transferred to the conveying drum 41 of the image recording unit 40.

As described above, the dryer 84 is provided inside the transfer drum 80, and heated air blows toward the guide plate 82. While the sheet P is being conveyed from the processing liquid coating unit 30 to the image recording unit 40 by the transfer drum 80, heated air blows on the printing surface, and the processing liquid coated on the printing surface is dried (the solvent component in the processing liquid is evaporated and removed).

<Image Recording Unit>

The image recording unit 40 dots ink droplets of the respective colors of C, M, Y, and K onto the printing surface of the sheet P to draw a color image on the printing surface of the sheet P. The image recording unit 40 primarily includes the conveying drum (hereinafter, referred to as "image recording drum") 41 which conveys the sheet P, a pressing roller 42 which presses the printing surface of the sheet P to bring the rear surface of the sheet P into close contact with the circumferential surface of the image recording drum 41, a sheet floating detection sensor 43 which detects floating of the sheet P, ink jet heads 44C, 44M, 44Y, and 44K which eject ink droplets of the respective colors of C, M, Y, and K onto the sheet P to draw an image, and a back tension application device (back tension application unit) 300 which sucks the front surface (printing surface) of the sheet P at a position immediately before the pressing roller 42 to apply back tension to the sheet P.

The image recording drum 41 receives the sheet P from the transfer drum 80 (receives the sheet P with the leading end of the sheet P gripped by the grippers G), and rotates to transfer the sheet P along a predetermined conveying path.

The pressing roller 42 substantially has the same width as the width of the image recording drum 41, and is arranged near the sheet reception position of the image recording drum 41 (the position where the sheet P is received from the transfer drum 80). The sheet P transferred from the transfer drum 80 to the image recording drum 41 is nipped by the pressing roller 42, such that the rear surface thereof is brought into contact with the outer circumferential surface of the image recording drum 41.

The sheet floating detection sensor 43 detects floating of the sheet P having passed through the pressing roller 42 (detects a given level or more of floating from the outer circumferential surface of the image recording drum 41). The sheet floating detection sensor 43 includes a laser projector 43A which projects laser light and a laser receiver 43B which receives laser light.

The laser projector 43A projects laser light parallel to the shaft of the image recording drum 41 from one end of the image recording drum 41 toward the other end at a position of a predetermined height from the outer circumferential surface of the image recording drum 41 (a position of a height corresponding to the upper limit in the allowable range of floating).

The laser receiver 43B is arranged to be opposite the laser projector 43A with the traveling path of the sheet P by the image recording drum 41 interposed therebetween, and receives laser light projected from the laser projector 43A.

If floating above the allowable value occurs in the sheet P being conveyed by the image recording drum 41, laser light projected from the laser projector 43A is blocked by the sheet P. As a result, the amount of laser light to be received by the laser receiver 43B is lowered. The sheet floating detection sensor 43 detects the amount of laser light to be received by the laser receiver 43B to detect floating of the sheet P. That is, the sheet floating detection sensor 43 compares the amount of laser light to be received by the laser receiver 43B with a threshold value, and when the amount of received laser light is equal to or smaller than the threshold value, determines that floating (floating above the allowable value) occurs.

If floating above the allowable value is detected, the rotation of the image recording drum 41 is stopped, and conveying of the sheet P is stopped.

The sheet floating detection sensor 43 is configured to adjust the height (the height from the outer circumferential surface of the image recording drum 41) of laser light projected from the laser projector 43A. Accordingly, the allowable range of floating can be arbitrarily set.

The four ink jet heads 44C, 44M, 44Y, and 44K are arranged at the back of the sheet floating detection sensor 43 at regular spacing along the conveying direction of the sheet P. Each of the ink jet heads 44C, 44M, 44Y, and 44K includes a line head corresponding to the sheet width, and a nozzle surface is formed in the lower surface (the surface opposite the outer circumferential surface of the image recording drum 41) thereof. In the nozzle surface, nozzles are arranged at regular pitches in a direction perpendicular to the conveying direction of the sheet P (nozzle array). The ink jet heads 44C, 44M, 44Y, and 44K eject ink droplets from the nozzles toward the image recording drum 41.

Ink which is used by the ink jet recording apparatus 10 of this embodiment is aqueous ultraviolet curable ink, and contains a pigment, polymer particles, and a water-soluble polymerizable compound to be polymerized by active energy rays. The aqueous ultraviolet curable ink is curable by irradiation of ultraviolet rays, and has excellent anti-friction and high film strength.

As the pigment, a water-dispersible pigment in which at least a portion of the surface is coated with a polymer dispersant is used.

As the polymer dispersant, a polymer dispersant having an acid number of 25 to 1000 (KOH mg/g) is used. Self-dispersing stability is satisfactory, and aggregability when the processing liquid is in contact is satisfactory.

As the polymer particles, self-dispersing polymer particles having an acid number of 20 to 50 (KOH mg/g) are used. Self-dispersing stability is satisfactory, and aggregability when the processing liquid is in contact is satisfactory.

As the polymerizable compound, from the view point of preventing interference with the reaction of the aggregating agent, the pigment, and the polymer particles, a nonionic or cationic polymerizable compound is preferably used. A polymerizable compound having solubility in water equal to or greater than 10% by mass (equal to or greater than 15% by mass) is preferably used.

Ink contains an initiator which initiates polymerization of a polymerizable compound by active energy rays. The initiator may contain a compound which is appropriately selected and can initiate a polymerization reaction by active energy rays. For example, an initiator (for example, a photoinitiator or the like) which generates active species (radicals, acids, bases, or the like) by radiation, light, or an electron beam may be used. The initiator may also be contained in the processing liquid, or may be contained in at least one of ink and the processing liquid.

Ink contains 50 to 70% by mass of water. Ink may contain additives. For example, ink may contain known additives, such as a water-soluble organic solvent, an anti-drying agent (wetting agent), an anti-fading agent, an emulsion stabilizer, a penetration enhancer, an ultraviolet absorber, a preservative, an antifungal agent, a pH regulator, a surface tension regulator, an antifoamer, a viscosity modifier, a dispersant, a dispersion stabilizer, a corrosion inhibitor, and a chelating agent.

The back tension application device 300 sucks the front surface of the sheet P at a position immediately before the sheet P being conveyed by the image recording drum 41 is pressed by the pressing roller 42 (a position immediately before the sheet P enters between the image recording drum 41 and the pressing roller 42), and applies back tension to the sheet P. The back tension application device 300 sucks the front surface of the sheet P by the sheet guide 310 to apply back tension to the sheet P. The sheet guide 310 includes a guide surface with which the front surface of the sheet P is in slide contact. The front surface of the sheet P is sucked from the suction holes formed in the guide surface.

Back tension is applied to the sheet P by the back tension application device 300 immediately before the sheet P is pressed by the pressing roller 42, such that the pressing roller 42 can bring the sheet P into close contact with the outer circumferential surface of the image recording drum 41 without causing the occurrence of wrinkles.

The configuration of the back tension application device 300 will be described below in detail.

In the image recording unit 40 configured as above, the sheet P is conveyed along a predetermined conveying path by the image recording drum 41. The sheet P transferred from the transfer drum 80 to the image recording drum 41 is nipped by the pressing roller 42 while back tension is applied by the back tension application device 300, and is brought into close contact with the outer circumferential surface of the image recording drum 41. Next, the presence/absence of floating is detected by the sheet floating detection sensor 43. Thereafter, ink droplets of the respective colors of C, M, Y, and K are dotted from the ink jet heads 44C, 44M, 44Y, and 44K onto the printing surface, and a color image is drawn on the printing surface.

When floating of the sheet P is detected, conveying is stopped. Accordingly, it is possible to prevent the floated sheet P from being in contact with the nozzle surfaces of the ink jet heads 44C, 44M, 44Y, and 44K.

As described above, in the ink jet recording apparatus 10 of this example, aqueous ink is used for each color. Even when aqueous ink is used, as described above, the processing liquid is coated on the sheet P. Accordingly, even if a general printing sheet is used, it is possible to perform high-quality printing.

The sheet P with an image drawn thereon is transferred to the transfer drum 90. The sheet P is conveyed along a predetermined conveying path by the transfer drum 90 and transferred to the conveying drum 51 of the ink drying unit 50.

As described above, the dryer 94 is provided inside the transfer drum 90, and heated air blows toward the guide plate 92. Although ink drying treatment is performed by the subsequent ink drying unit 50, the sheet P is also subjected to drying treatment during conveying by the transfer drum 90.

Though not shown, the image recording unit 40 includes a maintenance unit which performs maintenance of the ink jet heads 44C, 44M, 44Y, and 44K. If necessary, the ink jet heads 44C, 44M, 44Y, and 44K can move to the maintenance unit and can be subjected to necessary maintenance.

<Ink Drying Unit>

The ink drying unit 50 dries liquid components which remain in the sheet P after image recording. The ink drying unit 50 primarily includes the conveying drum (hereinafter, referred to as "ink drying drum") 51 which conveys the sheet P, and an ink drying device 52 which performs drying treatment on the sheet P being conveyed by the ink drying drum 51.

The ink drying drum 51 receives the sheet P from the transfer drum 90 (receives the sheet P with the leading end of the sheet P gripped by the grippers G), and rotates to convey the sheet P along a predetermined conveying path.

The ink drying device 52 includes, for example, dryers (in this example, includes three dryers arranged along the conveying path of the sheet P), and blows heated air (for example, 80° C.) toward the sheet P being conveyed by the ink drying drum 51.

In the ink drying unit 50 configured as above, the sheet P is conveyed along a predetermined conveying path by the ink drying drum 51. During conveying, heated air blows from the ink drying device 52 on the printing surface, and ink applied to the printing surface is dried (solvent components are evaporated and remove).

Thereafter, the sheet P having passed through the ink drying device 52 is transferred from the ink drying drum 51 to the transfer drum 100 at a predetermined position. The sheet P is conveyed along a predetermined conveying path by the transfer drum 100 and transferred to the conveying drum 61 of the fixing unit 60.

As described above, the dryer 104 is provided inside the transfer drum 100 and blows heated air toward the guide plate 102. Accordingly, the sheet P is also subjected to drying treatment during conveying in the transfer drum 100.

<Fixing Unit>

The fixing unit 60 heats and presses the sheet P to fix an image recorded on the printing surface. The fixing unit 60 primarily includes the conveying drum (hereinafter, referred to as "fixing drum") 61 which conveys the sheet P, an ultraviolet light source 62 which irradiates ultraviolet rays onto the printing surface of the sheet P, and an inline sensor 64 which detects the temperature, humidity, or the like of the sheet P after printing and captures a printed image.

The fixing drum 61 receives the sheet P from the transfer drum 100 (receives the sheet P with the leading end of the sheet P gripped by the grippers G), and rotates to convey the sheet P along a predetermined conveying path.

The ultraviolet light source 62 irradiates ultraviolet rays onto the printing surface of the sheet P being conveyed by the fixing drum 61 to solidify the aggregate of the processing liquid and ink.

The inline sensor 64 includes a thermometer, a hygrometer, a CCD line sensor, or the like. The inline sensor 64 detects the temperature, humidity, or the like of the sheet P being conveyed by the fixing drum 61, and reads an image printed on the sheet P. Abnormality in the apparatus, defective ejection of the head, or the like is checked on the basis of the detection result of the inline sensor 64.

In the fixing unit 60 configured as above, the sheet P is conveyed along a predetermined conveying path by the fixing drum 61. During conveying, ultraviolet rays are irradiated from the ultraviolet light source 62 onto the printing surface, and the aggregate of the processing liquid and ink is solidified.

Thereafter, the sheet P which is subjected to fixing treatment is transferred from the fixing drum 61 to the collection unit 70 at a predetermined position.

<Collection Unit>

The collection unit 70 collects and stacks the sheet P executed to a sequence of printing treatment in a stacker 71. The collection unit 70 primarily includes the stacker 71 which collects the sheet P, and a sheet discharging conveyer 72 which receives the sheet P executed to fixing treatment by the fixing unit 60 from the fixing drum 61, and conveys the sheet P along a predetermined conveying path to discharge the sheet P to the stacker 71.

The sheet P subjected to fixing treatment by the fixing unit 60 is transferred from the fixing drum 61 to the sheet discharging conveyer 72, conveyed to the stacker 71 by the sheet discharging conveyer 72, and collected in the stacker 71.

<<Control System>>

Figure 2:
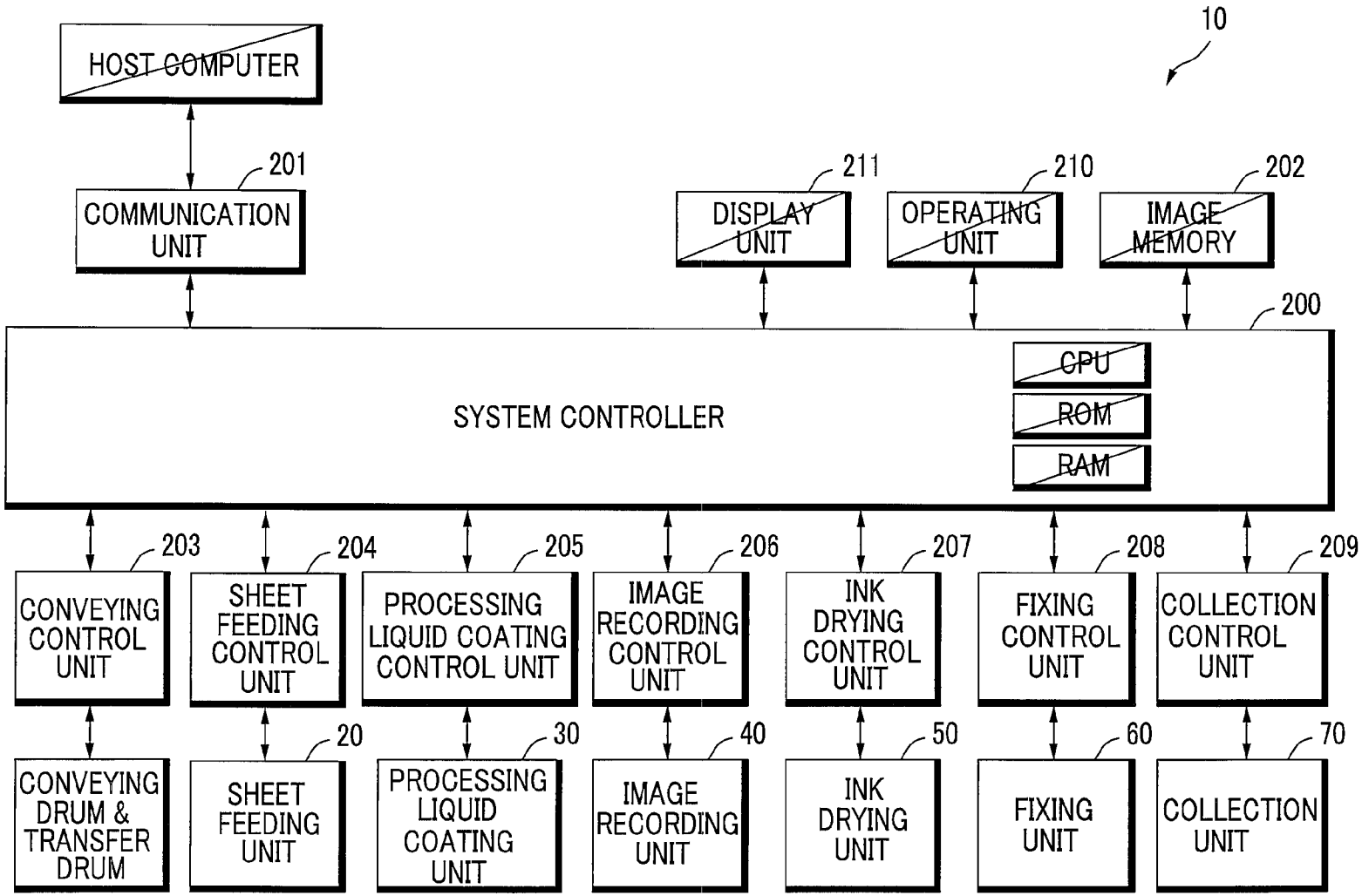
FIG. 2 is a block diagram showing the schematic configuration of a control system of the ink jet recording apparatus.

FIG. 2 is a block diagram showing the schematic configuration of a control system in the ink jet recording apparatus of this embodiment.

As shown in FIG. 2, the ink jet recording apparatus 10 includes a system controller 200, a communication unit 201, an image memory 202, a conveying control unit 203, a sheet feeding control unit 204, a processing liquid coating control unit 205, an image recording control unit 206, an ink drying control unit 207, a fixing control unit 208, a collection control unit 209, an operating unit 210, a display unit 211, and the like.

The system controller 200 functions as a control unit which performs is overall control of the respective units of the ink jet recording apparatus 10, and also functions as an arithmetic unit which performs various arithmetic processes. The system controller 200 includes a CPU, a ROM, a RAM, and the like, and operates in accordance with a predetermined control program. The ROM stores a control program which is executed by the system controller 200, and various kinds of data necessary for control.

The communication unit 201 includes a necessary communication interface, and performs data transmission and reception with respect to a host computer connected to the communication interface.

The image memory 202 functions as a unit which temporarily stores various kinds of data including image data. Data is read and written from and to the image memory 202 through the system controller 200. Image data loaded from the host computer through the communication unit 201 is stored in the image memory 202.

The conveying control unit 203 controls the driving of conveying drums 31, 41, 51, and 61 as the conveying unit of the sheet P in the processing liquid coating unit 30, the image recording unit 40, the ink drying unit 50, and the fixing unit 60, and the driving of the transfer drums 80, 90, and 100.

That is, the conveying control unit 203 controls the driving of the motors for driving the conveying drums 31, 41, 51, and 61, and also controls the opening/closing of the grippers G in the conveying drums 31, 41, 51, and 61.

Similarly, the conveying control unit 203 controls the driving of the motors for driving the transfer drums 80, 90, and 100, and controls the opening/closing of the grippers G in the transfer drums 80, 90, and 100.

Since a mechanism for adsorbing and holding the sheet P on the circumferential surface is provided in each of the conveying drums 31, 41, 51, and 61, the conveying control unit 203 controls the driving of the adsorbing and holding mechanism (in this embodiment, since the sheet P is adsorbed in a vacuum, the conveying control unit 203 controls the driving of a vacuum pump serving as a negative pressure generation unit (suction unit).).

Since the dryers 84, 94, and 104 are respectively provided in the transfer drums 80, 90, and 100, the conveying control unit 203 controls the driving (the amount of heat and the amount of air blow) of the dryers 84, 94, and 104.

The driving of the conveying drums 31, 41, 51, and 61 and the transfer drums 80, 90, and 100 is controlled in response to a command from the system controller 200.

The sheet feeding control unit 204 controls the driving of the respective units (sheet feeding device 21, the transfer drum 23, and the like) of the sheet feeding unit 20 in response to a command from the system controller 200.

The processing liquid coating control unit 205 controls the driving of the respective units (the coating device 32 and the like) of the processing liquid coating unit 30 in response to a command from the system controller 200.

The image recording control unit 206 controls the driving of the respective units (the pressing roller 42, the sheet floating detection sensor 43, the ink jet heads 44C, 44M, 44Y, and 44K, the back tension application device 300, and the like) of the image recording unit 40 in response to a command from the system controller 200.

The ink drying control unit 207 controls the driving of the respective units (the ink driving device 52 and the like) of the ink drying unit 50 in response to a command from the system controller 200.

The fixing control unit 208 controls the driving of the respective units (the ultraviolet light source 62, the inline sensor 64, and the like) of the fixing unit 60 in response to a command from the system controller 200.

The collection control unit 209 controls the driving of the respective units (the sheet discharging conveyer 72 and the like) of the collection unit 70 in response to a command from the system controller 200.

The operating unit 210 includes a necessary operating unit (for example, an operating button, a keyboard, a touch panel, or the like), and outputs operation information input from the operating unit to the system controller 200. The system controller 200 performs various processes in response to operation information input from the operating unit 210.

The display unit 211 includes a necessary display device (for example, an LCD panel or the like), and displays necessary information on the display device in response to a command from the system controller 200.

As described above, image data to be recorded on a sheet is loaded from the host computer to the ink jet recording apparatus 10 through the communication unit 201, and stored in the image memory 202. The system controller 200 performs a necessary signal process on image data stored in the image memory 202 to generate dot data, and controls the driving of each ink jet head of the image recording unit 40 in response to generated dot data, such that an image represented by image data is recorded on a sheet.

In general, dot data is generated through a color conversion process and a halftone process on image data. The color conversion process is a process in which image data (for example, RGB 8-bit image data) represented by sRGB is converted to ink amount data of the respective colors of ink which is used by the ink jet recording apparatus 10 (in this example, is converted to ink amount data of the respective colors of C, M, Y, and K). The halftone process is a process in which ink amount data of the respective colors generated through the color conversion process is converted to dot data of the respective colors through a process, such as error diffusion.

The system controller 200 performs the color conversion process and the halftone process on image data to generate dot data of the respective colors. The driving of the corresponding ink jet head is controlled in response to generated dot data of each color, such that an image represented by image data is recorded on a sheet.

<<Printing Operation>>

Next, a printing operation by the ink jet recording apparatus 10 will be schematically described.

If a sheet feed command is output from the system controller 200 to the sheet feeding device 21, the sheet P is fed from the sheet feeding device 21 to the sheet feed tray 22. The sheet P fed to the sheet feed tray 22 is transferred to the processing liquid coating drum 31 of the processing liquid coating unit 30 through the transfer drum 23.

The sheet P transferred to the processing liquid coating drum 31 is conveyed along a predetermined conveying path by the processing liquid coating drum 31. During conveying, the processing liquid is coated on the printing surface of the sheet P by the coating device 32.

The sheet P with the processing liquid coated thereon is transferred from the processing liquid coating drum 31 to the transfer drum 80. The sheet P is conveyed along a predetermined conveying path by the transfer drum 80 and transferred to the image recording drum 41 of the image recording unit 40. While the sheet P is being conveyed by the transfer drum 80, heated air blows from the dryer 84 provided inside the transfer drum 80 on the printing surface, and the processing liquid coated on the printing surface is dried.

The sheet P transferred from the transfer drum 80 to the image recording drum 41 is first nipped by the pressing roller 42, such that the rear surface thereof is brought into close contact with the outer circumferential surface of the image recording drum 41.

After the sheet P has passed through the pressing roller 42, the presence/absence of floating is detected by the sheet floating detection sensor 43. If floating of the sheet P is detected, conveying is stopped. When floating is not detected, the sheet P is directly conveyed toward the ink jet heads 44C, 44M, 44Y, and 44K. When the sheet P passes below the ink jet heads 44C, 44M, 44Y, and 44K, ink droplets of the respective colors of C, M, Y, and K are ejected from the ink jet heads 44C, 44M, 44Y, and 44K, such that a color image is drawn on the printing surface.

The sheet P with an image drawn thereon is transferred from the image recording drum 41 to the transfer drum 90. The sheet P is conveyed along a predetermined conveying path by the transfer drum 90 and transferred to the ink drying drum 51 of the ink drying unit 50. While the sheet P is being conveyed by the transfer drum 90, heated air blows from the dryer 94 provided inside the transfer drum 90 on the printing surface, and ink applied to the printing surface is dried.

The sheet P transferred to the ink drying drum 51 is conveyed along a predetermined conveying path by the ink drying drum 51. During conveying, heated air blows from the ink driving device 52 on the printing surface, such that liquid components remaining in the printing surface are dried.

The sheet P subjected to drying treatment is transferred from the ink drying drum 51 to the transfer drum 100. The sheet P is conveyed along a predetermined conveying path by the transfer drum 100 and transferred to the fixing drum 61 of the fixing unit 60. While the sheet P is being conveyed by the transfer drum 100, heated air blows from the dryer 104 provided inside the transfer drum 100 on the printing surface, and ink applied to the printing surface is further dried.

The sheet P transferred to the fixing drum 61 is conveyed along a predetermined conveying path by the fixing drum 61. During conveying, ultraviolet rays are irradiated onto the printing surface, and the drawn image is fixed to the sheet P. Thereafter, the sheet P is transferred from the fixing drum 61 to the sheet discharging conveyer 72 of the collection unit 70, conveyed to the stacker 71 by the sheet discharging conveyer 72, and discharged into the stacker 71.

As described above, in the ink jet recording apparatus 10 of this example, the sheet P is drum-conveyed, and during conveying, the processes of processing liquid coating, drying, ink droplet dotting, drying, and fixing are performed on the sheet P, and a predetermined image is recorded on the sheet P.

<<Details of Sheet Conveying Mechanism in Image Recording Unit>>

Figure 3:
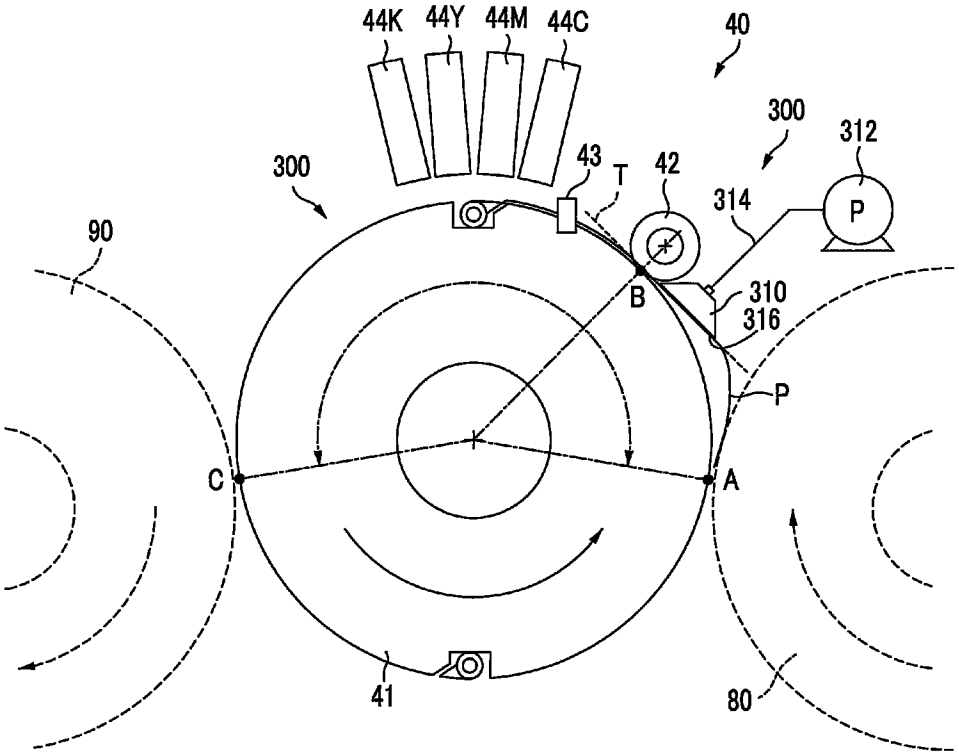
FIG. 3 is a side view showing the schematic configuration of a sheet conveying mechanism of an image recording unit.
Figure 4:
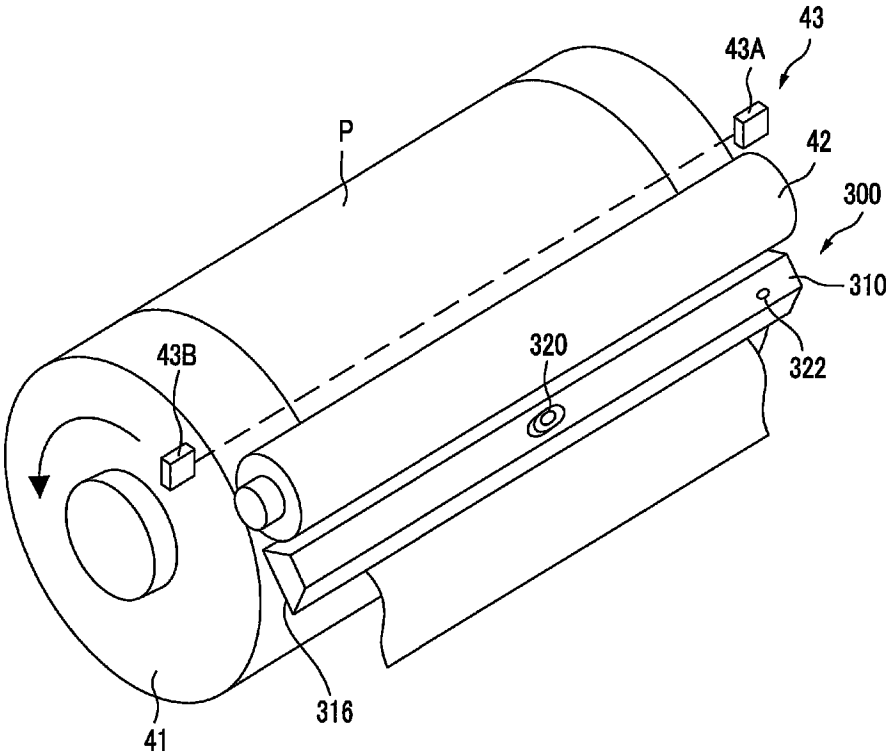
FIG. 4 is a perspective view showing the schematic configuration of a sheet conveying mechanism of an image recording unit.

FIG. 3 is a side view showing the schematic configuration of a sheet conveying mechanism of an image recording unit. FIG. 4 is a perspective view showing the schematic configuration of a sheet conveying mechanism of an image recording unit.

As described above, the image recording unit 40 includes the image recording drum 41 which conveys the sheet P, the pressing roller 42 which nips the sheet P being conveyed by the image recording drum 41 and brings the sheet P into close contact with the circumferential surface of the image recording drum 41, the sheet floating detection sensor 43 which detects floating of the sheet P being conveyed by the image recording drum 41, the ink jet heads 44C, 44M, 44Y, and 44K which eject ink droplets onto the sheet P being conveyed by the image recording drum 41, and the back tension application device 300 which sucks the front surface (printing surface) of the sheet P at a position immediately before the pressing roller 42 to apply back tension to the sheet P.

The image recording drum 41 receives the sheet P being conveyed by the transfer drum 80 at a predetermined reception position A, and rotates in the axis direction to convey the sheet P along an arc-shaped conveying path. At this time, the sheet P is adsorbed and held on the outer circumferential surface and conveyed. That is, a plurality of suction holes are formed in the circumferential surface of the image recording drum 41 in a regular pattern, and air is sucked from the inside through the suction holes to adsorb and hold the sheet P wrapped around the outer circumferential surface.

In the image recording drum 41 of this embodiment, the operation range of adsorption is limited, and adsorption operates only in a range of a predetermined adsorption start position B to an adsorption end position C. The adsorption start position B is set at a position away from the reception position A by a given distance (a position rotated at a given angle), and the adsorption end position C is set at a position where the sheet P is transferred to the transfer drum 90. Accordingly, after the sheet P is conveyed from the reception position A by a given distance, adsorption is started.

As shown in FIG. 4, the pressing roller 42 includes a rubber roller (a roller whose outer circumferential portion is coated with rubber) substantially having the same width as the width of the image recording drum 41, and is arranged at a position on the upstream side of the ink jet head in the conveying direction of the sheet P. In this example, the pressing roller 42 is arranged at the adsorption start position B.

The pressing roller 42 is arranged in parallel to the image recording drum 41 (is arranged to be perpendicular to the conveying direction of the sheet P) while both ends of a shaft portion are supported by a shaft bearing (not shown). The shaft bearing is pressed by a pressing mechanism (for example, a spring) (not shown) and urged toward the image recording drum 41. Accordingly, the pressing roller 42 is pressed against and brought into contact with the outer circumferential surface of the image recording drum 41.

If the sheet P transferred to the image recording drum 41 at the reception position is conveyed to the adsorption start position B, the sheet P is nipped by the pressing roller 42 and brought into close contact with the outer circumferential surface of the image recording drum 41. Simultaneously, suction is started.

The sheet floating detection sensor 43 detects floating of the sheet P having passed through the pressing roller 42. Accordingly, the sheet floating detection sensor 43 is provided at the back of the pressing roller 42 (on the downstream side in the conveying direction of the sheet P by the image recording drum 41).

As shown in FIG. 4, the sheet floating detection sensor 43 includes the laser projector 43A which projects laser light, and the laser receiver 43B which receives laser light.

The laser projector 43A projects laser light parallel to the shaft of the image recording drum 41 from one end of the image recording drum 41 in the width direction toward the other end at a position of a predetermined height from the outer circumferential surface of the image recording drum 41 (a position of a height corresponding to the upper limit in the allowable range of floating).

The laser receiver 43B is arranged to be opposite the laser projector 43A with the traveling path of the sheet P by the image recording drum 41 interposed therebetween, and receives laser light projected from the laser projector 43A. The laser receiver 43B detects the amount of received laser light and outputs the detection result to the system controller 200.

The system controller 200 detects floating of the sheet P on the basis of information regarding the obtained amount of received light. That is, if floating above the allowable value occurs in the sheet P, laser light projected from the laser projector 43A is blocked by the sheet P. As a result, the amount of laser light to be received by the laser receiver 43B is lowered. The system controller 200 compares the amount of laser light to be received by the laser receiver 43B with the threshold value, when the amount of received laser light is equal to or smaller than the threshold value, determines that floating (floating above the allowable value) occurs, and detects floating. Accordingly, it is possible to detect floating of the sheet P.

If floating above the allowable value is detected, the system controller 200 stops the rotation of the image recording drum 41 and stops conveying of the sheet P. Accordingly, it is possible to prevent the floated sheet P from being in contact with the nozzle surface of the ink jet head.

The sheet floating detection sensor 43 is configured to adjust the height (the height from the outer circumferential surface of the image recording drum 41) of laser light projected and received by the laser projector 43A and the laser receiver 43B. Accordingly, it is possible to arbitrarily set the allowable range of floating depending on the thickness or the like of the sheet P.

The adjustment of laser light to be projected and received is done, for example, by changing the installation height of the laser projector 43A and the laser receiver 43B. Besides, an angle-adjustable transparent parallel plate (for example, a glass parallel plate) may be provided in front of the laser projector 43A and the laser receiver 43B, and the height of laser light to be projected and received may be adjusted using refraction (if the transparent parallel plate is arranged to be perpendicular to laser light, laser light goes straight; however, if the transparent parallel plate is provided to be inclined, laser light is refracted during incidence and emission, and the height of laser light may be adjusted.).

An aperture may be provided in front of the laser projector 43A and the laser receiver 43B, thereby excluding unnecessary light and performing higher-precision detection.

As shown in FIG. 3, the back tension application device 300 sucks the front surface of the sheet P at a position immediately before the sheet P being conveyed by the image recording drum 41 is pressed by the pressing roller 42 (a position immediately before the sheet P enters between the image recording drum 41 and the pressing roller 42) to apply back tension to the sheet P.

The back tension application device 300 primarily includes the sheet guide 310 and the vacuum pump 312.

The sheet guide 310 is formed in a hollow box shape (a box shape which is widened toward the end), in which the cross-section parallel to the conveying direction of the sheet P has a trapezoidal shape, to correspond to the sheet width. Accordingly, the width (the width in a direction perpendicular to the conveying direction of the sheet P) is substantially the same as the width of the image recording drum 41.

The surface (lower surface) of the sheet guide 310 on the image recording drum side becomes a guide surface 316 which sucks the front surface (printing surface) of the sheet P and guides traveling of the sheet P, and is formed to be flat.

The sheet guide 310 is provided near the pressing roller 42 and arranged such that the guide surface 316 follows a tangent line line T to the image recording drum 41 at the installation point of the pressing roller 42 (the point where the pressing roller 42 and the outer circumferential surface of the image recording drum 41 are in contact with each other (in this example, the adsorption start position B)) (arranged such that the installation point of the pressing roller 42 is on the extended line of the guide surface 316).

Figure 5:
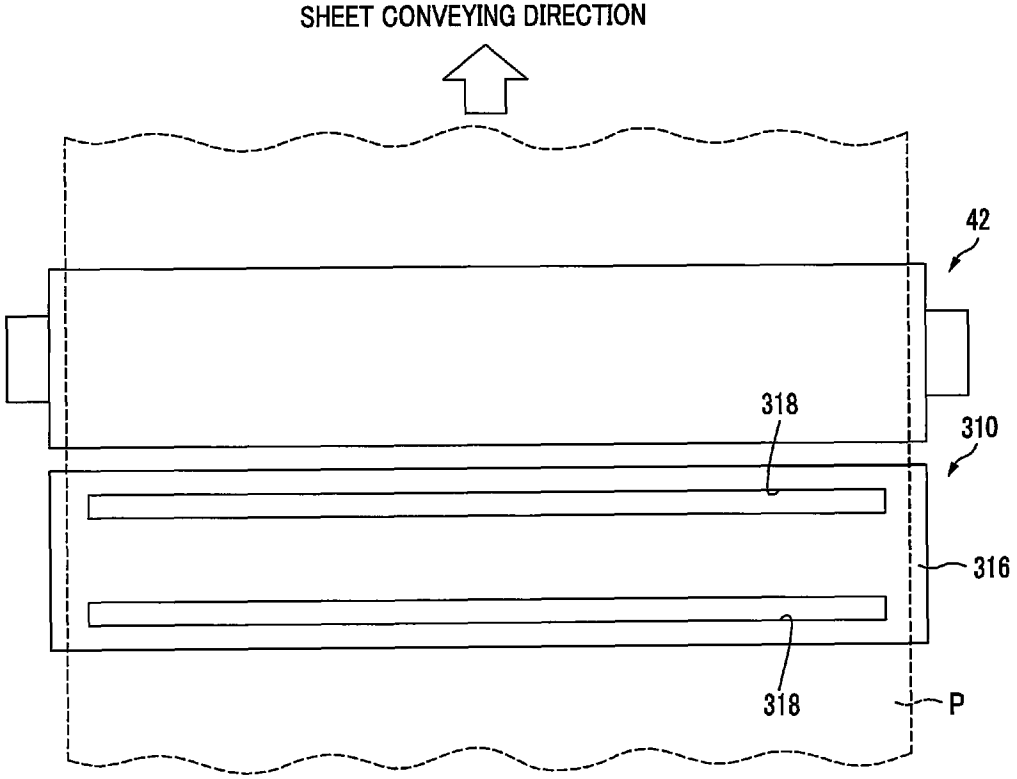
FIG. 5 is a bottom view of a sheet guide (a plan view of a guide surface).

FIG. 5 is a bottom view of a sheet guide (a plan view of a guide surface). As shown in FIG. 5, suction holes 318 are formed in the guide surface 316. The suction holes 318 are formed in a slit shape in a direction perpendicular to the conveying direction of the sheet P (in parallel to the shaft of the pressing roller 42). The suction holes 318 communicate with the inside (hollow portion) of the sheet guide formed in a hollow shape.

The number of suction holes 318 is not particularly limited, and is appropriately selected depending on the length or the like of the guide surface 316 in the forth-back direction (the conveying direction of the sheet P). In this example, two suction holes 318 are formed forth and back in the conveying direction of the sheet P.

A suction port 320 is formed in the central portion of the upper surface (the surface opposite to the guide surface 316) of the sheet guide 310. The suction port 320 communicates with the inside (hollow portion) of the sheet guide 310 formed in a hollow shape. Air is sucked from the suction port 320, such that air is sucked from the suction holes 318 formed in the guide surface 316.

A vacuum prevention hole 322 is formed in the upper surface of the sheet guide 310. The vacuum prevention hole 322 releases a pressure in the sheet guide 310 to prevent the application of an excess suction force. Since the vacuum prevention hole 322 is provided to prevent the application of the excess suction force, the installation position, size, and the number of vacuum prevention holes are appropriately adjusted in a range which meets the purpose.

The vacuum pump 312 is connected to the suction port 320 of the sheet guide 310 through an suction pipe 314. If the vacuum pump 312 is driven, the inside (hollow portion) of the sheet guide 310 is sucked, and air is sucked from the suction holes 318 formed in the guide surface 316. The driving of the vacuum pump 312 is controlled by the system controller 200 through the image recording control unit 206.

The back tension application device 300 is configured as above.

<<Action of Sheet Conveying Mechanism in Image Recording Unit>>

As described above, the sheet P is transferred from the transfer drum 80 to the image recording drum 41. The image recording drum 41 receives the sheet P from the transfer drum 80 at the predetermined reception position A.

The sheet P is received by gripping the leading end of the sheet P with the grippers G. The sheet P is received while rotating.

The sheet P whose leading end is gripped by the grippers G is conveyed by rotation of the image recording drum 41. The front surface (printing surface) of the sheet P is pressed by the pressing roller 42 at the installation position of the pressing roller 42, and the sheet P is brought into close contact with the outer circumferential surface of the image recording drum 41.

In the ink jet recording apparatus 10 of this example, the sheet guide 310 is provided in front of the pressing roller 42 (on the upstream side in the conveying direction of the sheet P).

Although the guide surface 316 of the sheet guide 310 is provided away from the outer circumference of the image recording drum 41, air is sucked from the suction holes 318 from the guide surface 316 at the same time with the operation of the ink jet recording apparatus 10 (the vacuum pump 312 is driven).

As a result, the sheet P is conveyed by the image recording drum 41 while the front surface (printing surface) of the sheet P is sucked by the suction holes 318 at a position immediately before the sheet P is pressed by the pressing roller 42 and the front surface of the sheet P is adsorbed by the guide surface 316 (the sheet P is conveyed while the front surface of the sheet P is in slide contact with the guide surface 316). Accordingly, back tension is applied to the sheet P which is entering between the pressing roller 42 and the image recording drum 41.

As described above, in the sheet conveying mechanism of this embodiment, the front surface of the sheet P is sucked at a position immediately before the sheet P enters between the pressing roller 42 and the image recording drum 41, and back tension is applied to the sheet P. Accordingly, when the front surface of the sheet P is pressed by the pressing roller 42 and the sheet P is brought into close contact with the outer circumference of the image recording drum 41, it is possible to bring the sheet P into close contact with the outer circumference of the image recording drum 41 without causing the occurrence of wrinkles. The front surface of the sheet P is sucked at a position immediately before the sheet P enters between the pressing roller 42 and the image recording drum 41, such that the distance from the point where the sheet P is pressed by the pressing roller 42 to the point where the sheet P is sucked by the sheet guide 310 is shortened, thereby further reducing wrinkles of the sheet P during this period.

In the sheet conveying mechanism of this embodiment, the guide surface 316 is arranged to follow the tangent line line T to the image recording drum 41 at the installation point of the pressing roller 42. Accordingly, it is possible to allow the sheet P to smoothly enter between the pressing roller 42 and the image recording drum 41. Therefore, it is possible to more effectively prevent the occurrence of wrinkles.

In the sheet conveying mechanism of this embodiment, since a configuration is made in which the front surface of the sheet P is sucked, for example, even if an image is recorded on the rear surface of the sheet P to be printed, it is possible to convey the sheet P without damaging the image. It is also possible to clean dust or the like stuck to the front surface of the sheet P through suction.

The sheet P having entered between the pressing roller 42 and the image recording drum 41 in a state where back tension is applied to the sheet P by the sheet guide 310 is brought into close contact with the outer circumferential surface of the image recording drum 41 while the front surface thereof is pressed by the pressing roller 42.

The image recording drum 41 operates suction when the sheet P reaches the point (hereinafter, referred to as the installation point) where the pressing roller 42 presses the sheet P. Accordingly, the rear surface of the sheet P is sucked from the suction holes formed in the outer circumferential surface of the image recording drum 41 at the same time with pressing by the pressing roller 42, and the sheet P is adsorbed and held on the outer circumferential surface of the image recording drum 41.

The sheet P passes through the installation portions of the ink jet heads 44C, 44M, 44Y, and 44K in a state of being adsorbed and held on the outer circumferential surface of the image recording drum 41, and an image is recorded on the front surface of the sheet P.

As described above, according to the sheet conveying mechanism of this embodiment, back tension is applied to the sheet P at a position near the pressing roller 42. Accordingly, it is possible to allow the sheet P to enter between the pressing roller 42 and the image recording drum 41 in a state where back tension is applied from the leading end of the sheet P to the trailing end. Therefore, it is possible to bring the sheet P into close contact with the outer circumference of the image recording drum 41 by the pressing roller 42 without causing the occurrence of wrinkles. In particular, in this embodiment, since the pressing roller 42 is provided at a position away from the reception position A of the sheet P, and the sheet P starts to be sucked from the installation position of the pressing roller 42 by the image recording drum 41, back tension is applied to the sheet P at a position near the pressing roller 42, thereby effectively preventing the occurrence of wrinkles in the sheet P.

In this embodiment, since the guide surface 316 is arranged to follow the tangent line T to the image recording drum 41 at the installation point of the pressing roller 42, it is possible to allow the sheet P to smoothly enter between the pressing roller 42 and the image recording drum 41.

In the sheet conveying mechanism of this embodiment, since a configuration is made in which the front surface of the sheet P is sucked, for example, even if an image is recorded on the rear surface of the sheet P to be printed, it is possible to convey the sheet P without damaging the image.

<<Other Modes of Guide Surface>>

In the foregoing embodiment, the shape of the guide surface 316 of the sheet guide 310 is flat. If the shape of the guide surface 316 is flat, it is possible to allow the sheet P to enter between the image recording drum 41 and the pressing roller 42 in a state where the sheet P is upright. Meanwhile, the shape of the guide surface 316 is not limited thereto. Hereinafter, another mode of the guide surface 316 of the sheet guide 310 will be described.

Figure 6B:
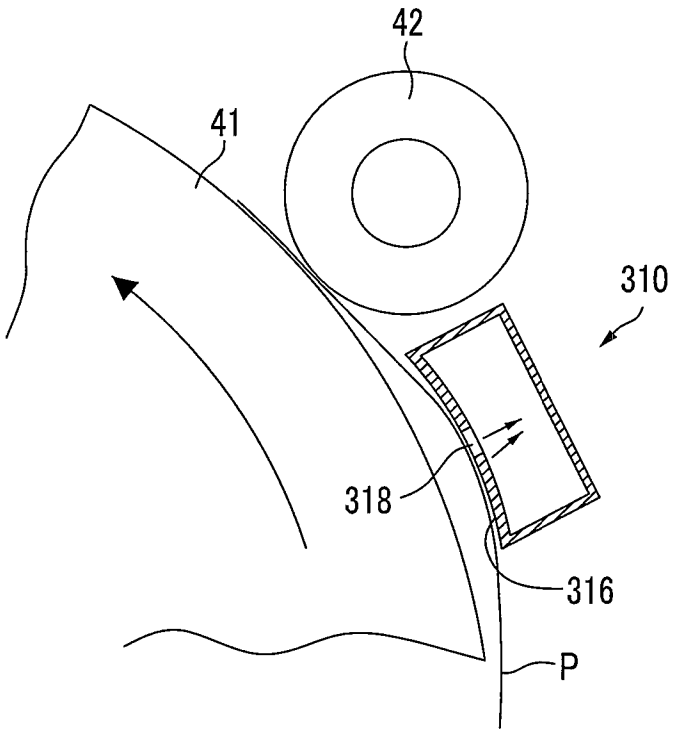
FIGS. 6A and 6B are diagrams showing another mode of a guide surface of a sheet guide.
Figure 6A:
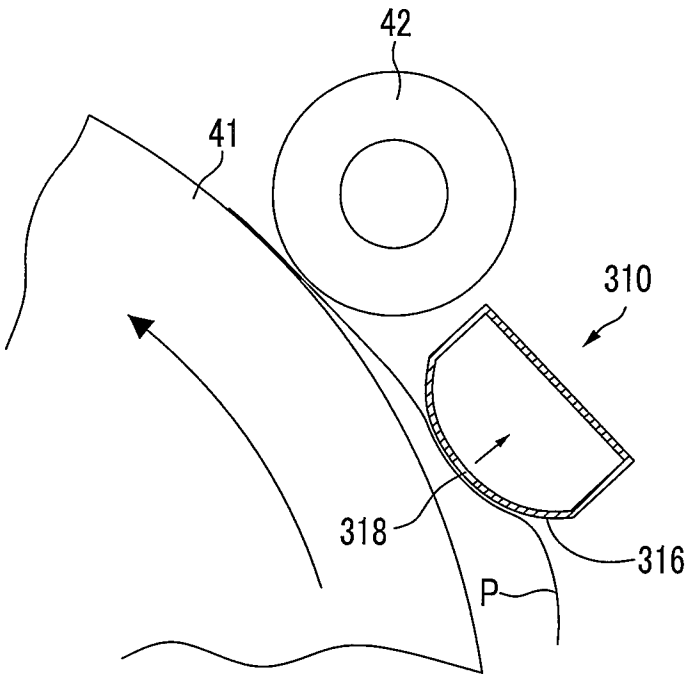

FIGS. 6A and 6B are diagrams showing another mode of a guide surface of a sheet guide.

FIG. 6A shows a case where the cross-section shape of the guide surface 316 in the forth-back direction (the direction parallel to the conveying direction of the sheet P) has an arc shape to be convex toward the image recording drum 41.

FIG. 6B shows a case where the cross-section shape of the guide surface 316 in the forth-back direction (the direction parallel to the conveying direction of the sheet P) has an arc shape to be concave with respect to the image recording drum 41.

If the cross-section in the direction parallel to the conveying direction of the sheet P has an arc shape, it is possible to increase the contact area of the sheet P and the guide surface 316. Accordingly, it is possible to increase an adsorbing and holding force and to stably guide the sheet P.

Although in the example of FIG. 6B, the suction hole 318 is formed only at the center of the guide surface 316 in the forth-back direction, the suction holes may be formed at multiple places in the forth-back direction. Therefore, it is possible to further increase the contact area.

The curvature of the arc is preferably set taking into consideration the installation position of the sheet guide 310 or the like such that the sheet P is easily guided between the pressing roller 42 and the image recording drum 41.

Figure 7:
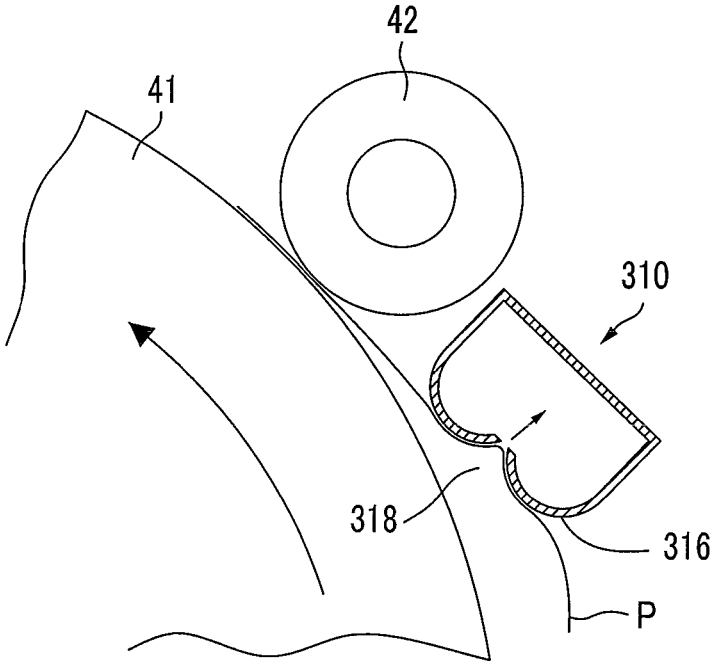
FIG. 7 is a diagram showing still another mode of a guide surface of a sheet guide.

FIG. 7 is a diagram showing still another mode of a guide surface of a sheet guide.

As shown in FIG. 7, the guide surface 316 is configured such that the cross-section in the forth-back direction (the direction parallel to the conveying direction of the sheet P) has a wave shape, and the suction hole 318 is formed in the trough portion of the guide surface 316.

With the formation of the suction hole 318, the sheet P is bent to be stretched toward the trough portion, thereby further increasing the adsorbing and holding force.

In this case, the suction hole 318 which is formed in the trough portion may have a slit shape, or circular holes or elongated holes may be formed at regular spacing along the trough portion.

Figure 8A:
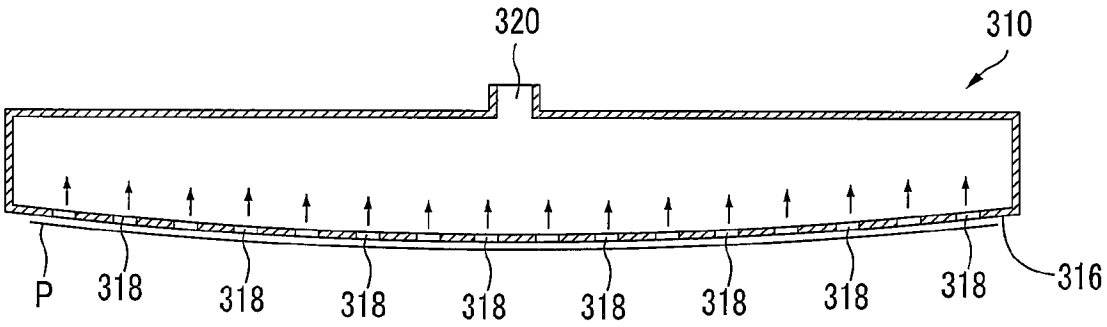
FIGS. 8A and 8B are diagrams showing a further mode of a guide surface of a sheet guide.
Figure 8B:
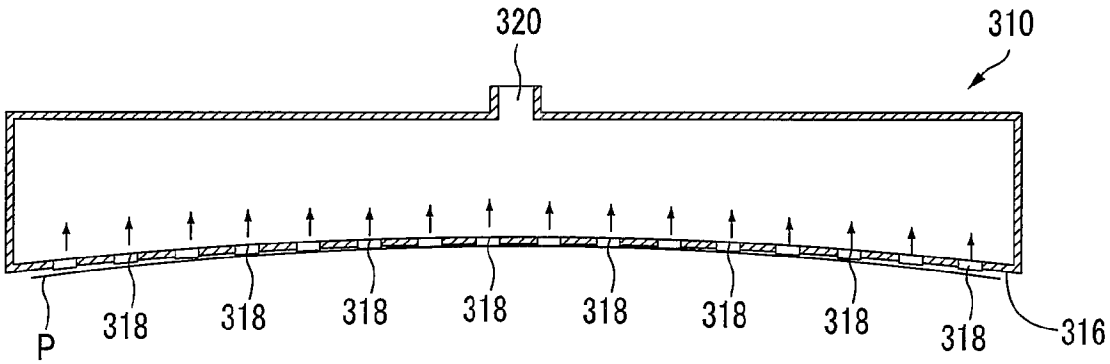

FIGS. 8A and 8B are diagrams showing a further mode of a guide surface of a sheet guide.

FIG. 8A shows a case where the cross-section shape of the guide surface 316 in the width direction (the direction perpendicular to the conveying direction of the sheet P) has an arc shape to be convex toward the image recording drum 41.

FIG. 8B shows a case where the cross-section shape of the guide surface 316 in the width direction (the direction perpendicular to the conveying direction of the sheet P) has an arc shape to be concave with respect to the image recording drum 41.

If the cross-section in the direction perpendicular to the conveying direction of the sheet P has an arc shape, since the sheet P follows the direction to be warped, it is possible to prevent slackness of the sheet P compared to a case where the cross-section is flat. Therefore, it is possible to more effectively prevent the occurrence of wrinkles during pressing by the pressing roller 42. As shown in FIG. 8A, if the cross-section has an arc shape to be convex toward the image recording drum 41, it is possible to bring the sheet P into close contact with the image recording drum 41 in sequence from the center of the sheet P toward both ends, thereby more effectively preventing the occurrence of wrinkles.

The cross-section in the direction perpendicular to the conveying direction of the sheet P may have an arc shape, and the cross-section parallel to the conveying direction of the sheet P may have an arc shape or a wave shape. Accordingly, it is possible to obtain the effects in both cases.

It is preferable that the optimum shape of the guide surface 316 is appropriately selected depending on the type, thickness, or the like of the sheet P to be used.

<<Other Modes of Suction Hole>>

In the foregoing embodiment, the suction hole 318 formed in the guide surface 316 has a slit shape and is formed to be perpendicular to the conveying direction of the sheet P. The suction hole 318 in the slit shape can continuously adsorb the sheet P in the width direction, thereby obtaining a large holding force.

As the shape of the suction hole 318, various shapes may be used, and it is preferable that the optimum shape is appropriately selected depending on the type, thickness, or the like of the sheet P to be used. Hereinafter, another mode of the suction hole 318 which is formed in the guide surface 316 will be described.

FIGS. 9A to 9G are diagrams showing another mode of a suction hole which is formed in a guide surface.

Figures 9A, 9B, 9C, 9D:
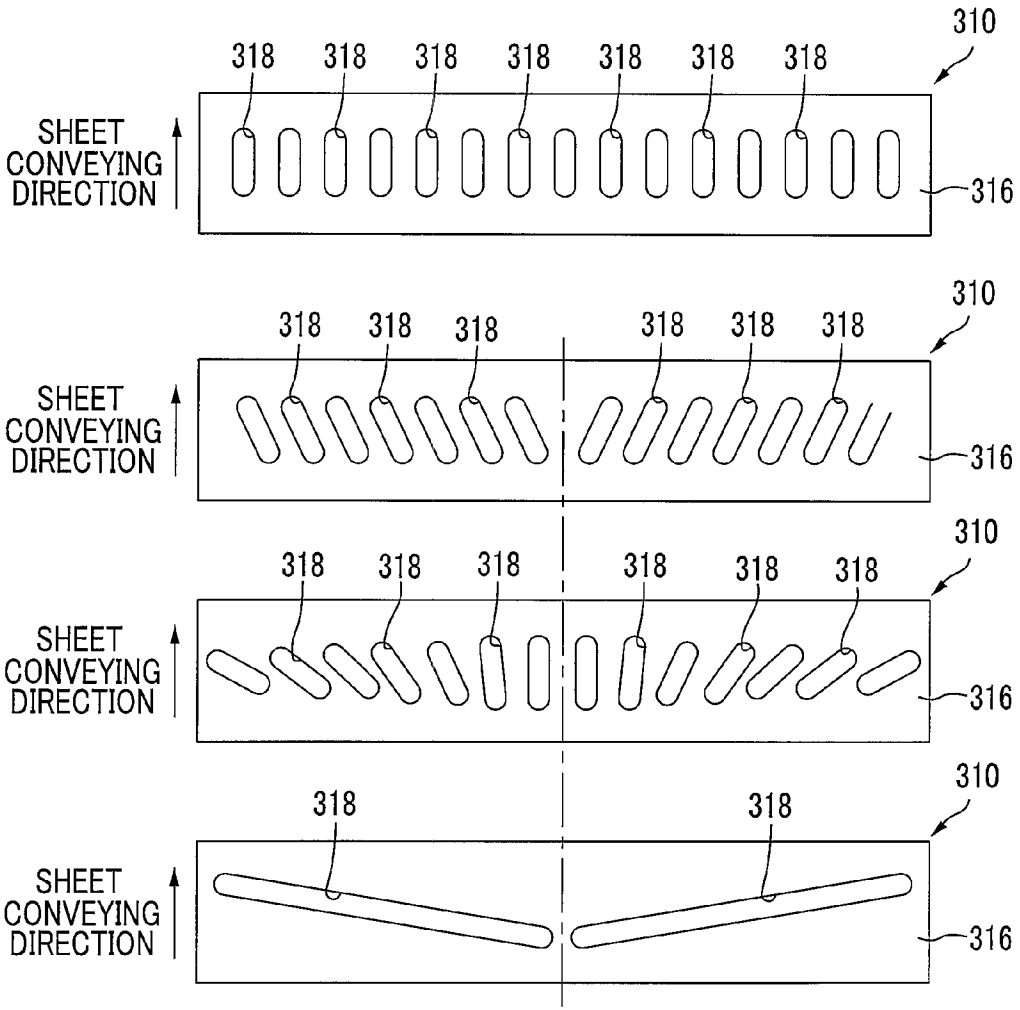
FIGS. 9A to 9G are diagrams showing another mode of a suction hole which is formed in a guide surface.

FIG. 9A shows a case where a plurality of suction holes 318 are formed at regular spacing in the width direction (the direction perpendicular to the conveying direction of the sheet P) of the guide surface 316. Therefore, it is possible to suppress deformation of the sheet P to smoothly guide the sheet P.

In this case, the shape of each suction hole 318 is not particularly limited. In the example shown in FIG. 9A, each suction hole 318 has an elongated hole shape which extends in the direction parallel to the conveying direction of the sheet. Therefore, it is possible to increase the holding force while suppressing deformation of the sheet. As shown in FIG. 9A, the elongated hole shape includes a shape in which both ends are formed in an arc shape, an elliptical shape, a rectangular shape (a so-called hole shape in which the vertical width and the horizontal width are different), and the like.

FIG. 9B shows a case where a plurality of suction holes 318 are formed at regular spacing in the width direction of the guide surface 316, each suction hole 318 has an elongated hole shape, and each suction hole 318 is formed to be inclined with respect to the conveying direction of the sheet P such that the end portion on the upstream side in the conveying direction of the sheet P is at the center of the guide surface 316 from the end portion on the downstream side. In this case, as shown in FIG. 9B, the suction holes 318 are formed to be symmetrical with respect to the center of the guide surface 316 in the width direction, and to be widened toward the end in the conveying direction of the sheet P.

With the formation of the suction holes 318, when the sheet P slides on the guide surface 316, it is possible to smooth wrinkles from the center of the sheet P toward both ends in the width direction. Therefore, it is possible to more effectively prevent the occurrence of wrinkles.

Similarly to FIG. 9B, FIG. 9C shows a case where a plurality of suction holes 318 are formed at regular pitches in the width direction of the guide surface 316, each suction hole 318 has an elongated hole shape, and each suction hole 318 is formed to be inclined with respect to the conveying direction of the sheet P such that the end portion on the upstream side in the conveying direction of the sheet P is at the center of the guide surface 316 from the end portion on the downstream side. Meanwhile, in this example, a suction hole 318 which is formed at a position further away from the center of the guide surface 316 has a larger inclination angle.

The suction holes 318 are formed in the above-described manner, thereby gradually smoothing wrinkles from the center of the sheet P toward both ends in the width direction and further increasing the effect of smoothing wrinkles.

FIG. 9D shows a case where slit-like suction holes 318 are arranged to be symmetrical with respect to the center of the guide surface 316 in the width direction, and each suction hole 318 is formed to be inclined with respect to the conveying direction of the sheet P such that the end portion on the upstream side in the conveying direction of the sheet P is at the center of the guide surface 316 from the end portion on the downstream side. In this case, as shown in FIG. 9D, the suction holes 318 are formed to be widened toward the end in the conveying direction of the sheet P.

Even when the suction holes 318 are formed in the above-described manner, it is possible to gradually smooth wrinkles from the center of the sheet P toward both ends in the width direction and to effectively prevent the occurrence of wrinkles.

Figure 9E:
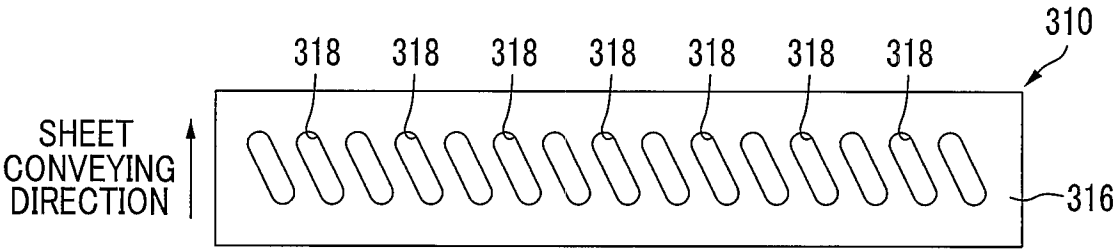

FIG. 9E shows a case where a plurality of suction holes 318 are formed at regular pitches in the width direction of the guide surface 316, each suction hole 318 has an elongated hole shape, and each suction hole 318 is formed to be inclined with respect to the conveying direction of the sheet P.

If the suction holes 318 are formed in the above-described manner, when the sheet P slides on the guide surface 316, it is possible to smooth wrinkles from one side of the sheet P in the width direction toward the other side.

Figure 9F:
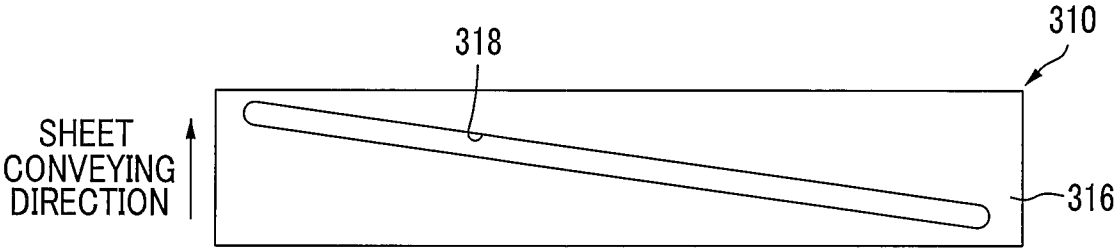

FIG. 9F shows a case where a slit-like suction hole 318 is formed along the diagonal of the guide surface 316 (the slit-like suction hole 318 is formed to be inclined with respect to the conveying direction of the sheet P).

If the suction hole 318 is formed in the above-described manner, when the sheet P slides on the guide surface 316, it is possible to smooth wrinkles from one side of the sheet P in the width direction toward the other side. It is also possible to continuously adsorb the sheet P in the width direction and to obtain a large holding force.

Figure 9G:
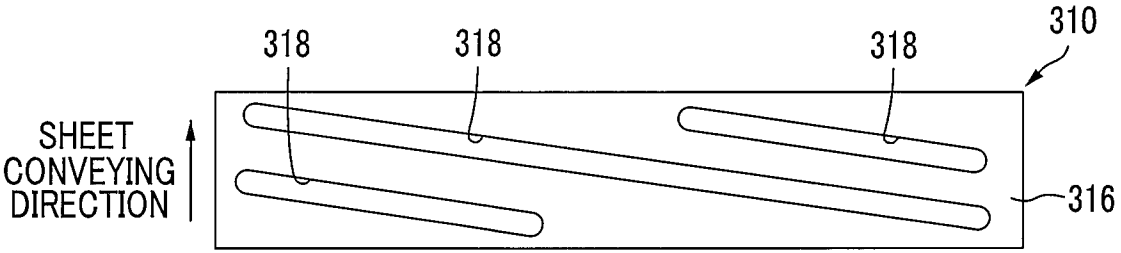

FIG. 9G shows a case where, similarly to in FIG. 9F, a slit-like suction hole 318 is formed along the diagonal of the guide surface 316, and a plurality of suction holes 318 parallel to the slit-like suction hole 318 are formed.

If the suction holes 318 are formed in the above-described manner, when the sheet P slides on the guide surface 316, it is possible to smooth wrinkles from one side of the sheet P in the width direction toward the other side and to further increase the holding force.

Figures 10A, 10B, 10C:
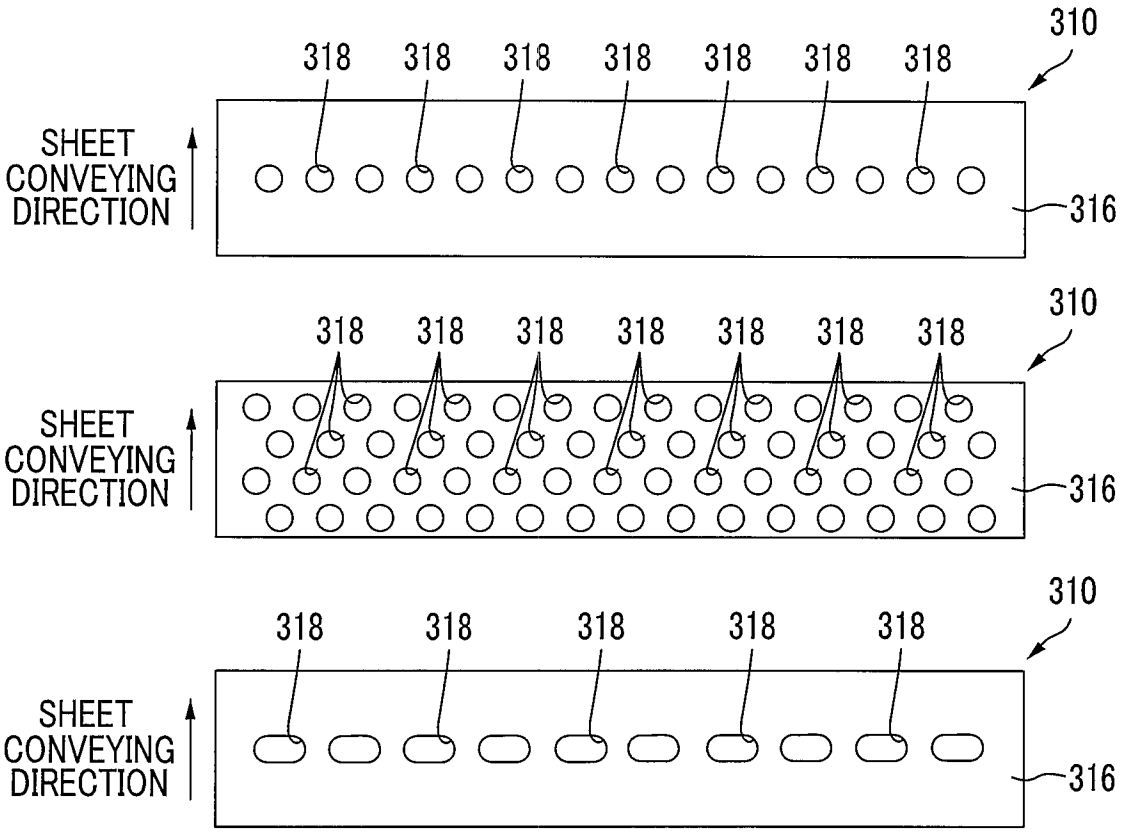
FIGS. 10A to 10C are diagrams showing still another mode of a suction hole which is formed in a guide surface.

FIGS. 10A to 10C are diagrams showing still another mode of a suction hole which is formed in a guide surface.

Although in the modes shown in FIGS. 9A to 9G the suction hole 318 has an elongated hole shape or a slit shape, the shape of the suction hole is not limited thereto.

FIG. 10A shows a case where a plurality of suction holes 318 in a circular hole shape are formed at regular spacing in the width direction (the direction perpendicular to the conveying direction of the sheet P) of the guide surface 316. The suction holes 318 have a circular hole shape, thereby facilitating manufacturing.

FIG. 10B shows a case where a plurality of suction holes 318 in a circular hole shape are formed in the guide surface 316. Accordingly, it is possible to increase an adsorption area, thereby further increasing the holding force.

FIG. 10C shows a case where a plurality of suction holes 318 are formed at regular spacing in the width direction of the guide surface 316, and each suction hole 318 has an elongated hole shape which extends in the width direction of the guide surface 316. Therefore, it is possible to suppress deformation of the sheet P while increasing the holding force.

Figure 11:
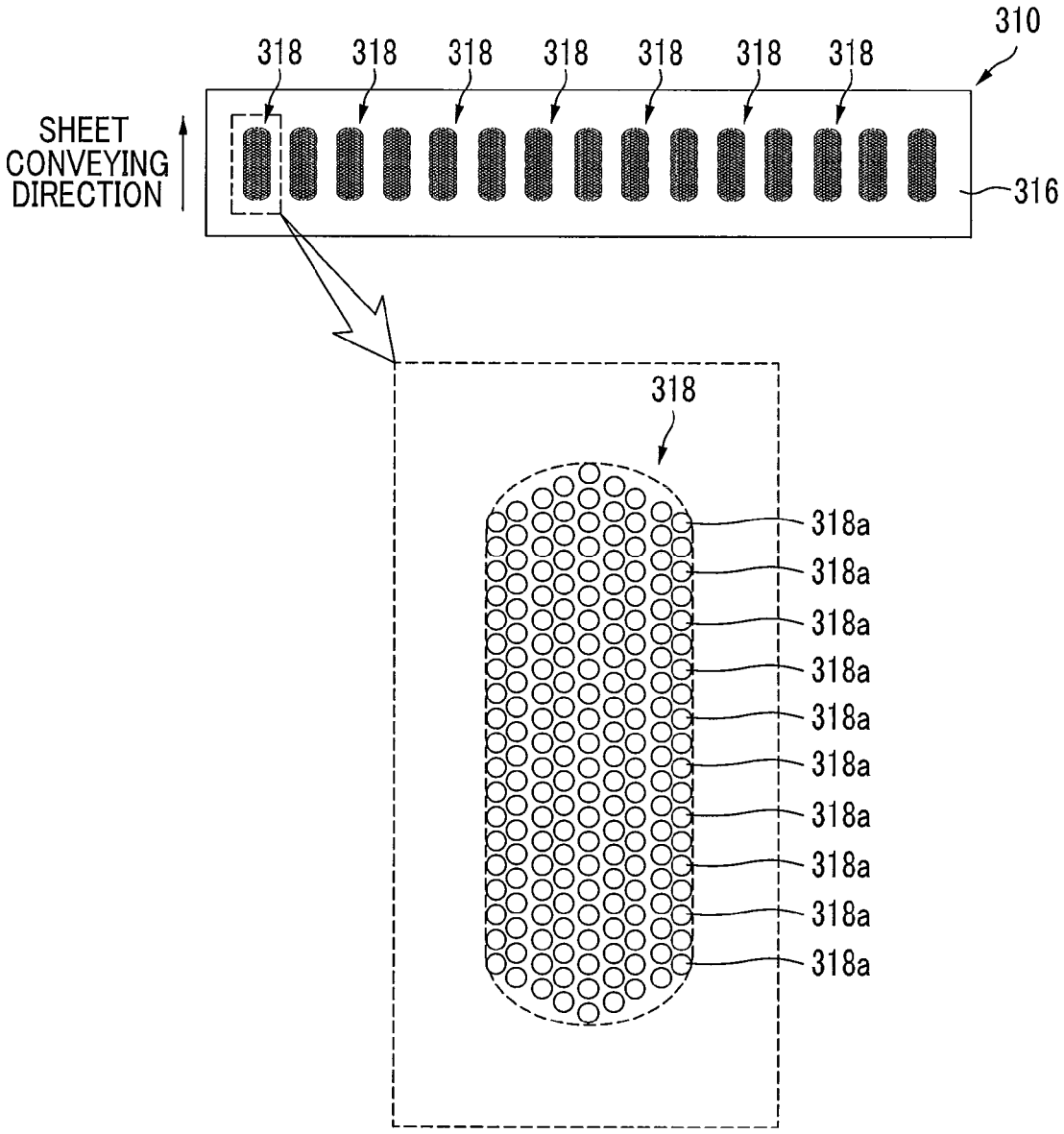
FIG. 11 is a diagram showing another mode of an adsorption hole.

When the suction hole 318 has an elongated hole shape, as shown in FIG. 11, a plurality of circular holes 318*a* having a small diameter may be assembled and an elongated hole shape may be formed as a whole (the appearance has an elongated hole shape as a whole). Therefore, it is possible to suppress deformation of the sheet P while obtaining a large holding force. It is also possible to facilitate manufacturing.

Although in the above-described examples, for convenience of description, the guide surface 316 is formed flat, the shape of the guide surface 316 is not limited thereto. Even when the suction holes 318 are formed in other modes of guide surfaces 316, similarly, various modes of suction holes 318 may be formed.

<<Other Modes of Sheet Guide Installation Method>>

Figure 12A:
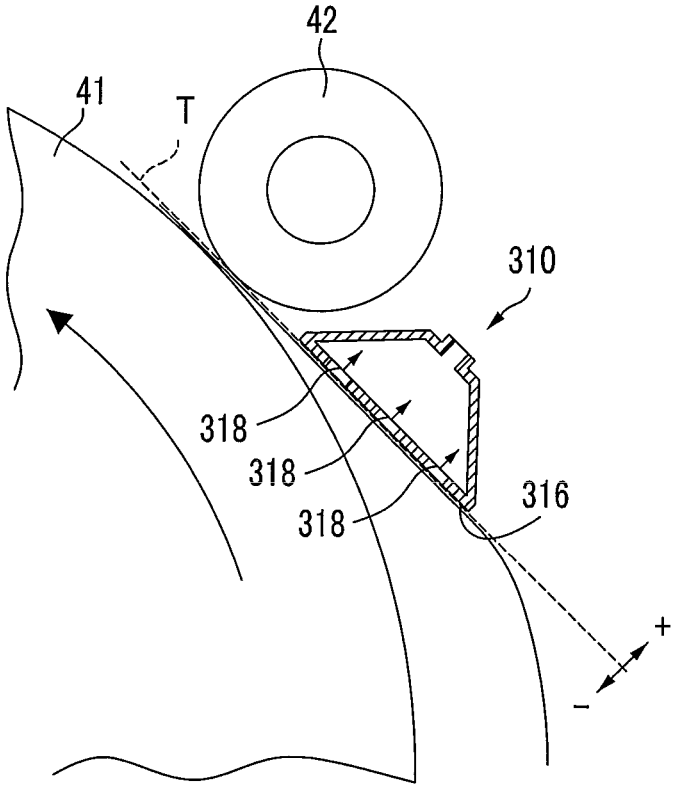
FIGS. 12A to 12C are diagrams showing another mode of a sheet guide installation method.

As shown in FIG. 12A, in the foregoing embodiment, the sheet guide 310 is arranged such that the guide surface 316 is arranged to follow the tangent line T to the image recording drum 41 at the installation point of the pressing roller 42 (the sheet guide 310 is arranged such that the installation point of the pressing roller 42 is on the extended line of the guide surface 316). With this arrangement of the sheet guide 310, it is possible to make the sheet P easy to enter between the pressing roller 42 and the image recording drum 41, thereby further increasing the effect of preventing wrinkles.

Figure 12B:
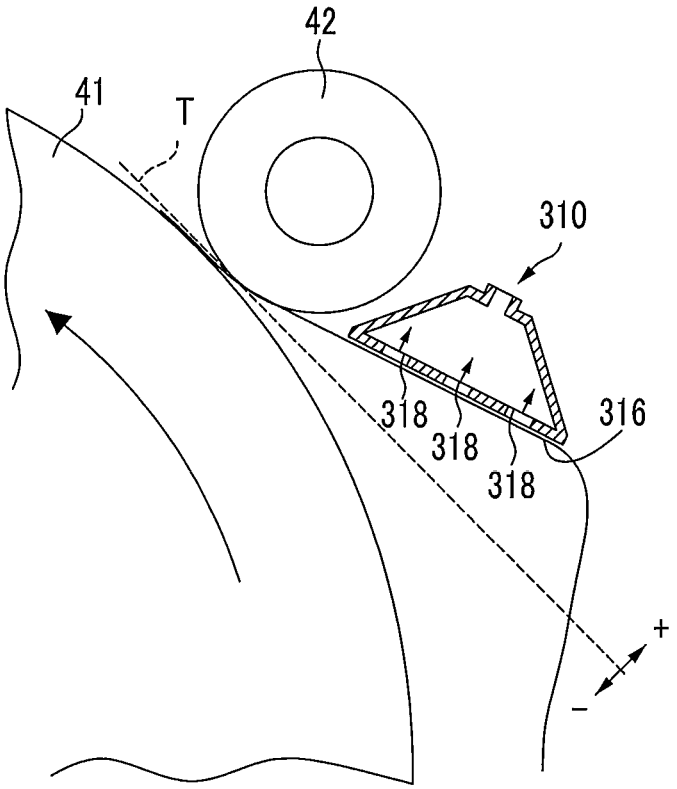
Figure 12C:
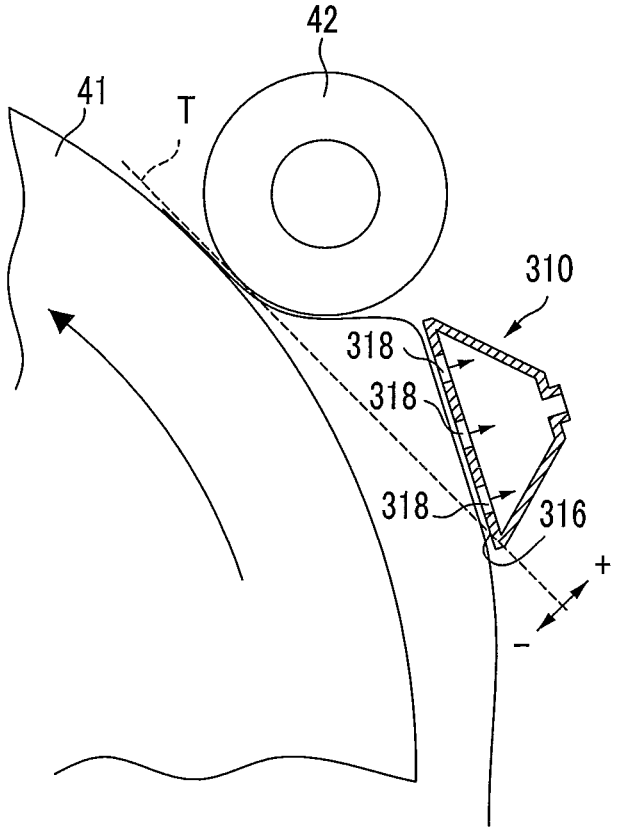

As shown in FIGS. 12B and 12C, the sheet guide 310 is provided such that the sheet P having passed through the sheet guide 310 is wrapped around the pressing roller 42, such that the area where the sheet P travels along the pressing roller 42 increase, thereby increasing the effect of smoothing wrinkles by the pressing roller 42.

In this case, as shown in FIGS. 12B and 12C, it is possible to provide the guide surface 316 to be inclined with respect to the tangent line T to the image recording drum 41 at the installation point of the pressing roller 42 (to provide the guide surface 316 such that the direction in which the guide surface 316 sucks the sheet P is inclined with respect to the tangent line T), thereby sucking the sheet P such that the sheet P having passed through the sheet guide 310 is wrapped around the pressing roller 42.

In particular, as shown in FIG. 12C, the guide surface 316 is provided to be inclined with respect to the tangent line T in the minus (−) direction (the guide surface 316 is provided such that the direction in which the guide surface 316 sucks the sheet P is opposite to the installation point of the pressing roller 42), thereby increasing the force of back tension.

As described above, with the adjustment of the installation position of the sheet guide 310, it is possible to adjust a way to apply back tension, a way to allow the sheet P to enter between the pressing roller 42 and the image recording drum 41, or the like. Meanwhile, it is preferable that the sheet guide 310 is appropriately provided in the optimum state depending on the type, thickness, or the like of the sheet P to be used. The installation position may be adjusted depending on the type, thickness, or the like of the sheet P to change a way of suction. For example, the guide surface 316 may be supported swingably around the shaft parallel to the shaft of the image recording drum 41, and the direction (suction direction) of the guide surface 316 may be changed. Accordingly, it is possible to adjust a way of suction. It may also be possible to adjust the position of a height from the outer circumferential surface of the image recording drum 41 (the gap between the outer circumferential surface of the image recording drum 41 and the guide surface 316).

It is preferable to provide the sheet guide 310 such that the guide surface 316 is as near the outer circumferential surface of the image recording drum 41 as possible. Therefore, it is possible to stably suck the sheet P.

<<Other Modes of Sheet Guide>>

As the contact area to the sheet P is greater, the sheet guide 310 can obtain a stronger holding force. Accordingly, the longer the length (the length in the forth-back direction) of the guide surface 316 in the sheet conveying direction, the better. The length is set taking into consideration the installation space or the like, and set to a length such that the maximum effect is obtained.

It is preferable that the length in the direction perpendicular to the conveying direction of the sheet P is set to be substantially the same width as the sheet width. Accordingly, it is preferable to form the guide surface 316 substantially at the same width as the width of the image recording drum 41.

Figures 13A, 13B, 13C:
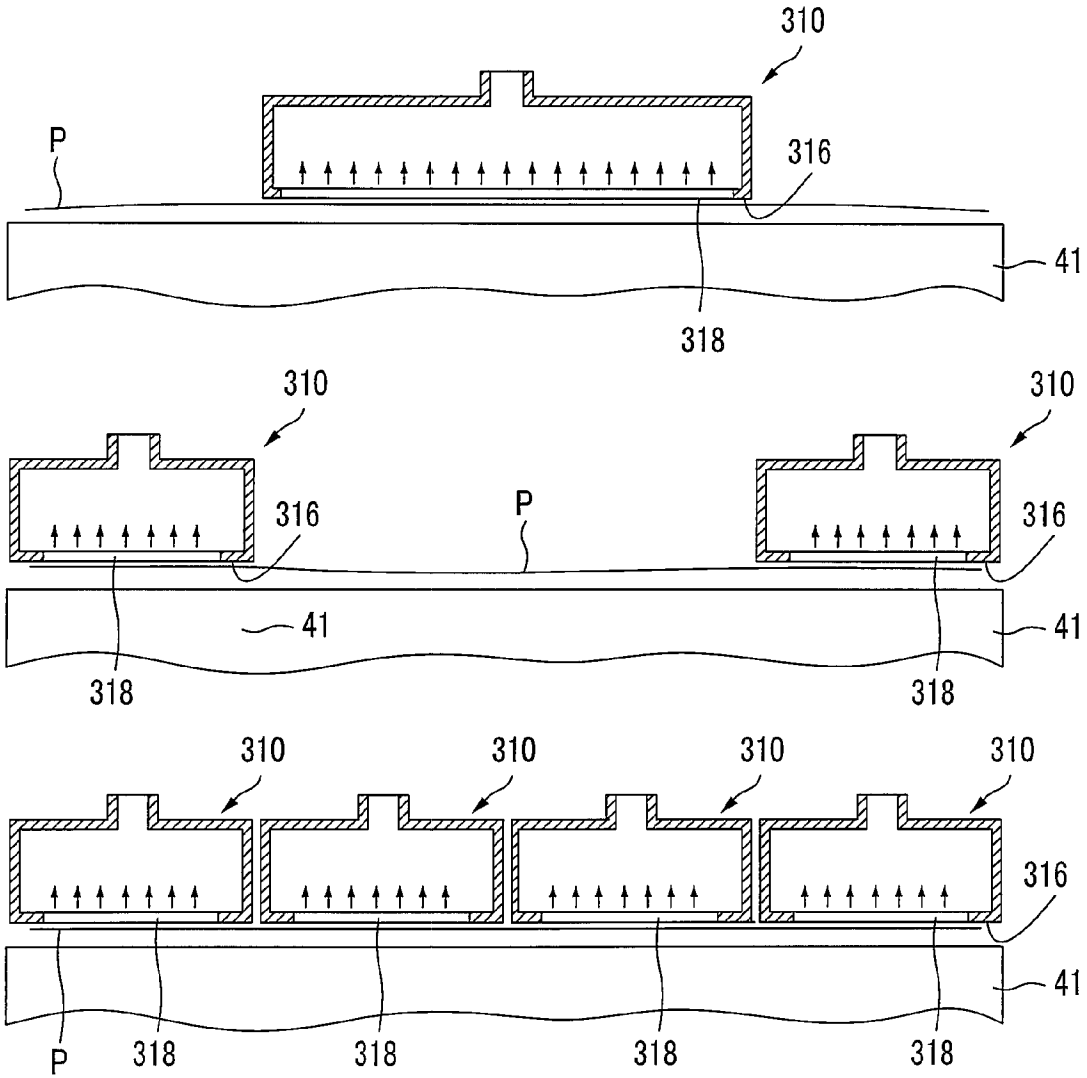
FIGS. 13A to 13C are diagrams showing another mode of a sheet guide.

Meanwhile, as shown in FIG. 13A, only the central portion of the sheet P may be sucked depending on the installation space, the type of the sheet P to be used, or the like.

As shown in FIG. 13B, a pair of sheet guides 310 may be used to suck both end portions of the sheet P in the width direction.

A plurality of sheet guides 310 may be arranged in parallel in the direction perpendicular to the conveying direction of the sheet P. In this case, although a single vacuum pump may be used to suck each sheet guide 310, a vacuum pump may be separately provided in each sheet guide 310 to separately suck the sheet guide 310. Accordingly, it is possible to switch the suction width in accordance with the size of the sheet P. Even when a single vacuum pump is used, for example, a valve may be provided in a suction pipe which connects each sheet guide 310 and the vacuum pump (suction may be separately ON/OFF), thereby obtaining the same effects.

Figure 14:
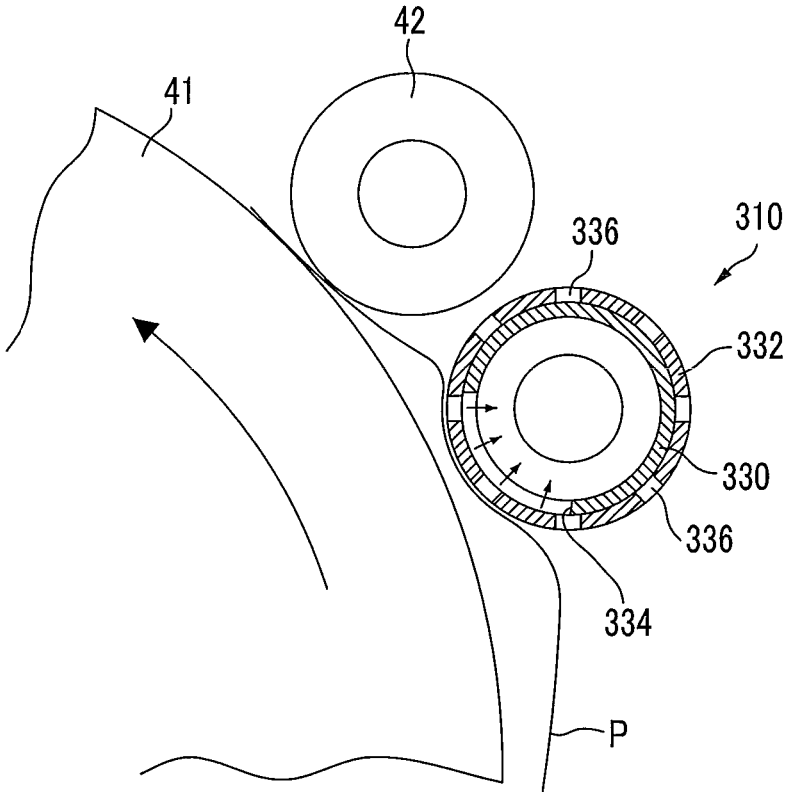
FIG. 14 is a diagram showing another mode of a sheet guide.

As shown in FIG. 14, the sheet guide 310 may be formed in a roller shape.

The sheet guide 310 shown in FIG. 14 has a double-pipe structure having an internal cylinder 330 and an external cylinder 332, and is formed substantially at the same width as the image recording drum 41.

The internal cylinder 330 is formed in a cylindrical shape. The internal cylinder 330 is fixed in a state where both ends are supported by a bracket (not shown).

The external cylinder 332 is formed in a cylindrical shape. The external cylinder 332 is provided to be rotatable around the outer circumferential portion of the internal cylinder 330 through bearings (not shown).

An opening 334 is formed in the circumferential surface of the internal cylinder 330 in a given angle range. A plurality of suction holes 318 are formed in the outer circumferential portion of the external cylinder 332.

A suction port (not shown) is formed at one end of the internal cylinder 330. The suction port is connected to a vacuum pump through a suction pipe.

If the vacuum pump is driven, air in the internal cylinder 330 is sucked. Accordingly, air is sucked from the suction holes 318 formed in the external cylinder 332. If air is sucked from the suction holes 318, the front surface of the sheet P being conveyed by the image recording drum 41 is sucked.

The sheet P is sucked from the suction holes 318 and then brought into close contact with the outer circumferential surface of the external cylinder 332. Since the external cylinder 332 is rotatably provided, the external cylinder 332 rotates (co-rotates) along with traveling of the sheet P.

If the sheet guide 310 has a roller shape and co-rotates along with the sheet P, it is possible to prevent the front surface of the sheet P from being worn.

Although in this example, the external cylinder 332 is rotatably supported by the outer circumference of the internal cylinder 330, and the sheet guide 310 co-rotates along with the sheet P, the sheet guide 310 may be driven by a rotary driving unit, such as a motor, and may be rotated as the same speed as the sheet P.

The external cylinder 332 may be driven by a rotary driving unit, such as a motor, and may be rotated in the direction opposite to the conveying direction of the sheet P. Accordingly, it is possible to increase the force of back tension.

<<Suction Method>>

Although the back tension application device 300 may constantly operate while the ink jet recording apparatus 10 is in operation, air may be constantly sucked by a given suction force from the sheet guide 310, it is preferable to control the suction force in accordance with conveying of the sheet P.

For example, in the leading end portion of the sheet P, suction is performed by a strong suction force, and thereafter, the suction force is weakened. If the sheet P can be adsorbed once, the state can be held; however, if the initial suction force is weak, adsorption may not be performed. Accordingly, in the leading end portion of the sheet P, suction is performed by a strong suction force, and thereafter, the suction force is weakened. Therefore, it is possible to appropriately suck the sheet P.

Besides, the suction for may be gradually weakened toward the trailing end portion of the sheet P.

Other Embodiments

Although in the foregoing embodiment, a case where the present invention is applied to the sheet conveying mechanism of the image recording drum 41 has been described, the present invention may be applied to other sheet conveying mechanisms. For example, the present invention may be applied to the sheet conveying mechanism of the processing liquid coating unit 30. In this case, the back tension application device is provided at a position immediately before the coating device 32 (coating roller). Accordingly, it is possible to prevent the occurrence of wrinkles in the sheet P which is pressed by the coating roller.

A plurality of sheet guides 310 may be arranged along the conveying direction of the sheet P.

What is claimed is:

1. A sheet conveying device which conveys sheets, comprising:

a drum which rotates with a sheet wound around the outer circumferential surface thereof to convey the sheet;

a pressing roller which is provided on the outer circumferential surface of the drum, presses the front surface of the sheet to bring the rear surface of the sheet into close contact with the outer circumferential surface of the drum; and a back tension application unit which sucks the front surface of the sheet at a position immediately before the sheet enters between the drum and the pressing roller to apply back tension to the sheet;

wherein the back tension application unit includes a sheet guide which has a guide surface in slide contact with the front surface of the sheet, a suction hole being formed in the guide surface, and a suction unit which sucks the sheet from the suction hole to bring the front surface of the sheet into close contact with the guide surface, wherein the back tension application unit sucks the front surface of the sheet such that the sheet which enters between the drum and the pressing roller travels along the tangent line to the outer circumference of the drum at a contact of the drum and the pressing roller, and wherein the guide surface is flat along the tangent line to the outer circumference of the drum at a contacting point of the drum and the pressing roller.

2. The sheet conveying device according to claim 1, wherein the drum has an adsorbing and holding unit which adsorbs and holds the rear surface of the sheet wound around the outer circumferential surface.

3. The sheet conveying device according to claim 1, wherein the drum has a leading end gripping unit which grips the leading end of the sheet.

4. The sheet conveying device according to claim 1, wherein the cross-section shape of the guide surface in a direction perpendicular to the conveying direction of the sheet has an arc shape.

5. The sheet conveying device according to claim 1, wherein the cross-section shape of the guide surface in a direction parallel to the conveying direction of the sheet has an arc shape.

6. The sheet conveying device according to claim 1, wherein the guide surface is flat.

7. The sheet conveying device according to claim 1, wherein the slit-like suction hole in the guide surface is perpendicular to the conveying direction of the sheet.

8. The sheet conveying device according to claim 1, wherein the slit-like suction hole in the guide surface is inclined with respect to the conveying direction of the sheet.

9. The sheet conveying device according to claim 1, wherein a plurality of suction holes are formed in the guide surface at a predetermined spacing in a direction perpendicular to the conveying direction of the sheet.

10. The sheet conveying device according to claim 9, wherein each suction hole is an elongated hole which extends in parallel to the conveying direction of the sheet.

11. The sheet conveying device according to claim 10, wherein each suction hole is formed by assembling a plurality of circular holes and has an elongated hole shape as a whole.

12. The sheet conveying device according to claim 9, wherein each suction hole is an elongated hole which extends to be inclined with respect to the conveying direction of the sheet.

13. The sheet conveying device according to claim 12, wherein each suction hole is inclined such that an end portion on the upstream side in the conveying direction of the sheet is at the center of the guide surface from an end portion on the downstream side.

14. The sheet conveying device according to claim 13, wherein a suction hole which is further away from the center of the guide surface has a larger inclination angle.

15. The sheet conveying device according to claim 1, wherein the cross-section shape of the guide surface in a direction parallel to the conveying direction of the sheet has a wave shape, and the suction hole is formed in a trough portion.

16. The sheet conveying device according to claim 15, wherein only one suction hole is formed at a lower end of the trough portion.

17. The sheet conveying device according to claim 1, wherein the sheet guide has a hollow portion, the suction hole communicates with the hollow portion, a vacuum prevention hole communicates with the hollow portion, and the hollow portion is sucked by the suction unit.

18. The sheet conveying device according to claim 1, wherein the sheet guide is configured such that the direction of the guide surface is adjustable.

19. The sheet conveying device according to claim 1, wherein the back tension application unit sucks the front surface of the sheet such that the sheet is wrapped around the pressing roller.

20. The sheet conveying device according to claim 1, further comprising:

a rotating and conveying unit which rotates while gripping the leading end of the sheet to convey the sheet, wherein the sheet is fed from the rotating and conveying unit to the drum.

21. An ink jet recording apparatus comprising:

the sheet conveying device according to claim 1; and an ink jet head which ejects ink droplets onto the front surface of the sheet being conveyed by the drum.

22. The sheet conveying device according to claim 1, further comprising:

a processing liquid coating unit which coats a processing liquid on the front surface of the sheet and is positioned at an upstream side in the conveying direction of the sheet with respect to the drum; and a dryer which dries the processing liquid that is coated on the front surface of the sheet during conveying the sheet from the processing liquid coating unit to the drum.

23. A sheet conveying method using the sheet conveying device according to claim 1, the method comprising the steps of:

conveying a sheet that is wound around the outer circumferential surface of a drum by rotating the drum;

nipping the sheet between the drum and a pressing roller which is provided on the outer circumferential surface of the drum, wherein the pressing roller presses the front surface of the sheet to bring the rear surface of the sheet into close contact with the outer circumferential surface of the drum, while sucking the front surface of the sheet using a back tension application unit at a position immediately before the sheet entering between the drum and the pressing roller in order to apply back tension to the sheet.

* * * * *